US010465866B2

(12) United States Patent
Rioux et al.

(10) Patent No.: US 10,465,866 B2
(45) Date of Patent: Nov. 5, 2019

(54) LIGHT EMITTING DIODE TUBE LAMP INCLUDING GLASS LAMP TUBE WITH RETAINING RIDGES FOR ENGAGING LIGHT EMITTING DIODE BOARD TO TUBE LAMP

(71) Applicants: Philip Rioux, Brentwood, NH (US); Shiyong Zhang, Boxborough, MA (US)

(72) Inventors: Philip Rioux, Brentwood, NH (US); Shiyong Zhang, Boxborough, MA (US)

(73) Assignee: LEDVANCE LLC, Wilmington, MA (US)

( * ) Notice: Subject to any disclaimer, the term of this patent is extended or adjusted under 35 U.S.C. 154(b) by 96 days.

(21) Appl. No.: 15/727,143

(22) Filed: Oct. 6, 2017

(65) Prior Publication Data

US 2019/0107261 A1 Apr. 11, 2019

(51) Int. Cl.

| | |
|---|---|
| ***F21S 4/28*** | (2016.01) |
| ***F21K 9/27*** | (2016.01) |
| ***F21V 5/00*** | (2018.01) |
| ***F21V 23/00*** | (2015.01) |
| ***F21V 19/00*** | (2006.01) |
| ***F21K 9/61*** | (2016.01) |
| ***F21V 3/06*** | (2018.01) |
| ***F21K 9/90*** | (2016.01) |
| ***F21V 3/02*** | (2006.01) |
| ***F21V 29/85*** | (2015.01) |
| ***F21Y 115/10*** | (2016.01) |
| ***F21Y 103/10*** | (2016.01) |

(52) U.S. Cl.

CPC ..... *F21S 4/28* (2016.01); *F21K 9/27* (2016.08); *F21K 9/61* (2016.08); *F21K 9/90* (2013.01); *F21V 3/02* (2013.01); *F21V 3/061* (2018.02); *F21V 5/007* (2013.01); *F21V 19/003* (2013.01); *F21V 19/0045* (2013.01); *F21V 23/004* (2013.01); *F21V 29/86* (2015.01); *F21Y 2103/10* (2016.08); *F21Y 2115/10* (2016.08)

(58) Field of Classification Search

CPC ..... F21S 4/28; F21K 9/61; F21K 9/27; F21V 3/061; F21V 5/007; F21V 19/003; F21V 23/004; F21V 29/96; F21Y 2103/10; F21Y 2115/10

See application file for complete search history.

(56) References Cited

U.S. PATENT DOCUMENTS

| | | | | |
|---|---|---|---|---|
| 8,567,986 | B2 * | 10/2013 | Szprengiel | F21S 8/043 362/217.01 |
| 2009/0290334 | A1 * | 11/2009 | Ivey | F21V 23/06 362/219 |
| 2011/0038146 | A1 * | 2/2011 | Chen | F21V 19/001 362/225 |

(Continued)

*Primary Examiner* — Mary Ellen Bowman

(74) *Attorney, Agent, or Firm* — Tutunjian & Bitetto, PC

(57) ABSTRACT

A lamp tube including a glass tube body having a cross-sectional geometry that is perpendicular to a length of the glass tube body with a substantially cylindrical perimeter defined by a sidewall of the glass tube body enclosing a hollow interior for housing a light source. The sidewall of the glass tube body that defines the substantially cylindrical perimeter including at least one pair of ridges on opposing sides of the substantially cylindrical perimeter. Each ridge of the at least one pair of the ridges includes an apex extending towards the hollow interior for the glass tube body.

20 Claims, 15 Drawing Sheets

(56) References Cited

U.S. PATENT DOCUMENTS

| | | | | |
|---|---|---|---|---|
| 2012/0008315 | A1* | 1/2012 | Simon | F21V 21/005<br>362/217.13 |
| 2013/0050999 | A1* | 2/2013 | Simon | H05K 3/0061<br>362/218 |
| 2014/0306599 | A1* | 10/2014 | Edwards | F21V 3/02<br>313/502 |
| 2014/0376254 | A1* | 12/2014 | Arimoto | F21V 9/40<br>362/583 |
| 2016/0084482 | A1* | 3/2016 | Speer | F21K 9/27<br>362/222 |

* cited by examiner

LIGHT EMITTING DIODE TUBE LAMP INCLUDING GLASS LAMP TUBE WITH RETAINING RIDGES FOR ENGAGING LIGHT EMITTING DIODE BOARD TO TUBE LAMP

TECHNICAL FIELD

The present disclosure generally relates to lighting, and more particularly to lamp tubes used with light sources including light emitting diodes (LEDs).

BACKGROUND

Fluorescent light fixtures have been a popular form of lighting for many decades. A fluorescent lighting fixture includes one or more fluorescent tubes, with each tube having an end cap on each end of a tube. Lighting systems based on LED light sources are a fairly new technology in the lighting field. LED's are desirable because they have no mercury, and therefore, are more environment friendly. LED's also have a much longer lifetime, and use less power than fluorescent tubes of equivalent output.

SUMMARY

In one aspect, a lamp tube is provided for lamps, such as lamps including light sources including light emitting diodes (LEDs). In one embodiments, the lamp tube provided herein includes a glass tube body having a cross-sectional geometry that is perpendicular to the length of the glass tube body with a substantially cylindrical perimeter defined by a sidewall of the glass tube body for enclosing a hollow interior. The hollow interior of the glass tube body is for housing a light source. In some embodiments, the sidewall of the glass tube body further includes at least two ridges on opposing sides of the substantially cylindrical perimeter sidewall. In some examples of the lamp tube, each ridge of the at least two ridges in the glass sidewall includes an apex extending towards the hollow interior for the glass tube body. Each of the at least two ridges extends continuously with uniform dimensions along a majority of the length of the glass tube body. In some embodiments, the at least two ridges in the glass tube body can function to position a circuit board including a light source, such as a light source provided by light emitting diodes (LEDs), within the hollow interior of the lamp tube. The at least two ridges can function to position, e.g., engage to the sidewall of the lamp tube, the circuit board including the light source without any adhesives or mechanical means of engagement, such as clips or fasteners, e.g., nut and/or bolt arrangements.

In another aspect, a lamp is provided that includes a lamp tube having at least two ridges that are present in the lamp tube's sidewall. In one embodiment, the lamp includes a glass tube body having a cross-sectional geometry that is perpendicular to a length of the glass tube body with a substantially cylindrical perimeter defined by a sidewall of the glass tube body enclosing a hollow interior. The sidewall of the glass tube body that defines the substantially cylindrical perimeter includes at least two ridges on the substantially cylindrical perimeter. Each of the at least two ridges extends continuously with uniform dimensions along a majority of the length of the glass tube body. The lamp further includes a light source that is present within the hollow interior of the glass tube body. In some embodiment, the light source is present on a circuit board having edges in between the each of the at least two ridges and a portion of the sidewall of the glass tube body.

In another aspect, a method of assembling a lamp is provided, in which the lamp being assembled includes a glass tube body having at least two ridges present in the sidewall of the glass tube body. In one embodiment, the method of lamp assembly includes providing a glass tube body having a cross-sectional geometry that is perpendicular to the length of the glass tube body with a substantially cylindrical perimeter defined by a sidewall of the glass tube body enclosing a hollow interior for housing a light source. The sidewall of the glass tube body that defines the substantially cylindrical perimeter includes at least two ridges on opposing sides of the substantially cylindrical perimeter. Each of the at least two ridges extends continuously with uniform dimensions along a majority of the length of the glass tube body. The method may also include sliding a circuit board including at least one light source along the at least two ridges to position the circuit board including the at least one light source into the hollow interior of the glass tube body. In some embodiments, the edges of the circuit board are retained between the at least two ridges and a portion of the glass tube sidewall extending from a first ridge to a second ridge of the at least two ridges. In some embodiments, each of the at least two ridges extend along the length of the lamp tube from a first end of the lamp tube continuously to a second end of the lamp tube without any breaks or discontinuities. In some embodiments, the method may further include installing end caps having electrical contacts for electrical communication with a lamp fixture. In some examples, each of the end caps have alignment tabs for engagement to the at least two ridges at the opposing first and second ends of the glass tube body. The alignment tab for the end caps fits within divot faces on the exterior sidewall of the ridges at the first and second ends of the glass tube body that are provided by the at least two ridges.

In yet another aspect of the present disclosure, a method of forming a light tube is provided, in which the light tube includes at least two ridges that extend along the length of the lamp tube from a first end of the lamp tube continuously to a second end of the lamp tube. In one embodiment, the method may include forming a glass tube using a drawing process; and forming ridges in a sidewall of a glass tube body using a plurality of rollers while the glass material of the glass tube body is viscous, in which the ridges formed are retaining ridges for engaging a circuit board including a light source within a hollow interior of the glass tube body once it has solidified after the formation of the ridges. In some embodiments, the drawing process may include a mandrel for receiving molten glass, wherein the molten glass traverses through the mandrel while the mandrel is non-rotationally vibrated through magnetic interaction between a set of permanent magnets and electromagnets being cycled by an alternating current power source.

In a further aspect of the present disclosure, a method of forming a light tube is provided, in which the light tube includes at least one pair of ridges that extend along the length of the lamp tube from a first end of the lamp tube continuously to a second end of the lamp tube. In one embodiment, the method may include receiving a molten glass within a mandrel of a glass tube drawing operation, in which the mandrel includes molding surfaces for forming at least one pair of ridges in a glass tube. The method may continue with applying a vibrational motion to the mandrel by magnetic interaction between a permanent magnet connected to the mandrel and electromagnetics that are cycled by an alternating current power source. The vibrational motion traverse the molten glass through the mandrel across the molding surfaces to form the at least one pair of ridges in the glass tube. The glass tube is then solidified to provide a glass tube body having at least one pair of retaining ridges for engaging a circuit board including a light source within a hollow interior of the glass tube body. In some embodiments, the method may further include blowing air through an air pipe leading to a central portion of the mandrel to form the hollow interior of the glass tube body.

BRIEF DESCRIPTION OF THE DRAWINGS

The following description will provide details of embodiments with reference to the following figures wherein.

DETAILED DESCRIPTION

Figure 1A:
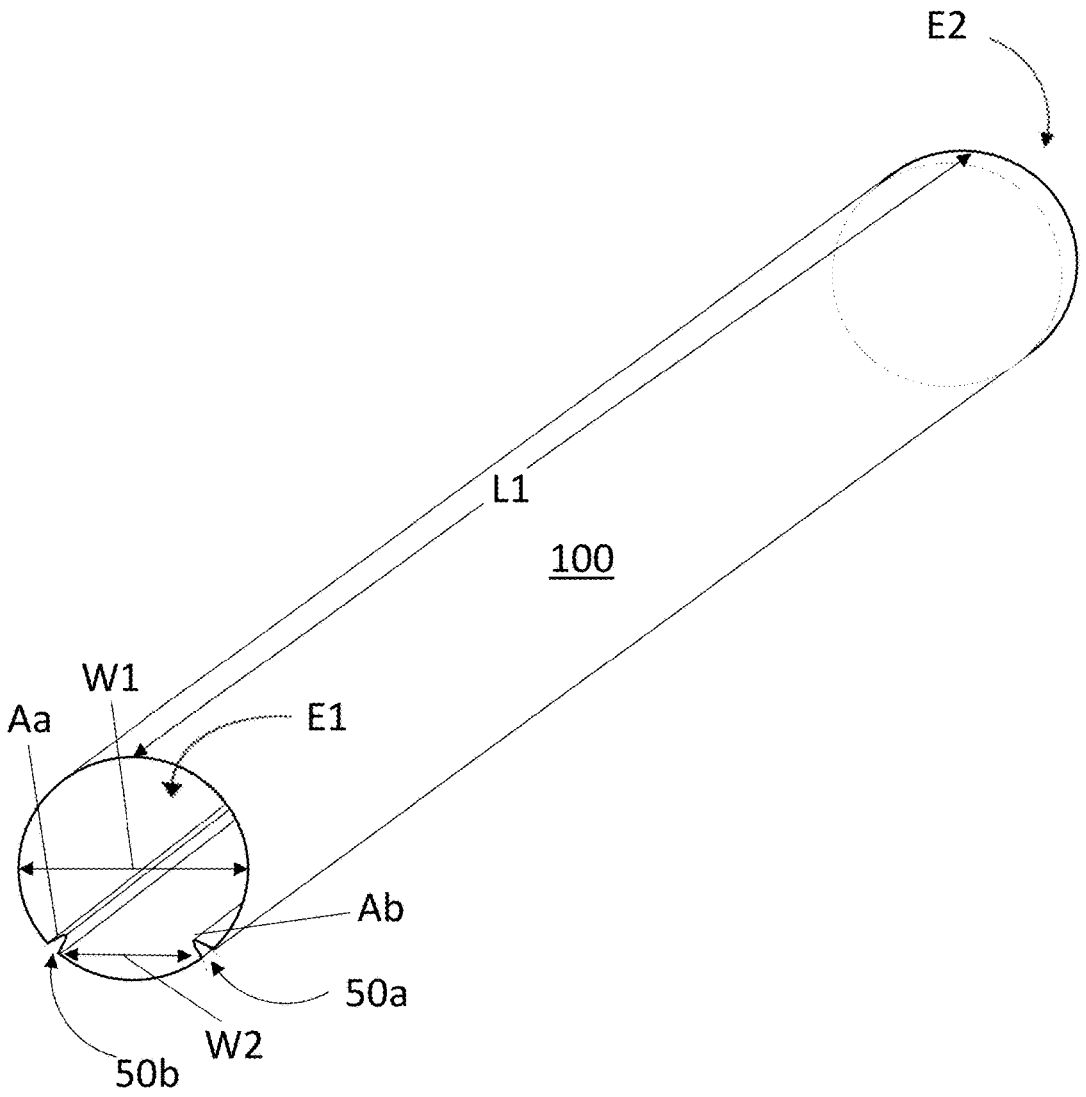
FIG. 1A is a perspective view of a glass tube body including at least two ridges that extend along the length of the lamp tube body from a first end of the lamp tube body continuously to a second end of the lamp tube body, in accordance with one embodiment of the present disclosure.

Reference in the specification to "one embodiment" or "an embodiment" of the present invention, as well as other variations thereof, means that a particular feature, structure, characteristic, and so forth described in connection with the embodiment is included in at least one embodiment of the present invention. Thus, the appearances of the phrase "in one embodiment" or "in an embodiment", as well any other variations, appearing in various places throughout the specification are not necessarily all referring to the same embodiment.

As light emitting diode (LED) light sources become a more attractive solution to lighting in fluorescent type lighting fixtures, glass tubes have been considered for light emitting diode (LED) lighting. In some examples, an existing glass tube for traditional fluorescent tube lamps is employed in LED type tube lamps, in which the circuit board, i.e., substrate, on which the LEDs are present is affixed to the glass tube using adhesive engagement, i.e., the light source for the LED lamp is adhesively glued to the sidewall of the glass tube. It has been determined that many disadvantages are inherent in the use of adhesive engagement between the light source and the glass tube. For example, it can be difficult to control the flow of the adhesive so that it is limited to only the portions of the assembly in which adhesive engagement is desired. In some instances, adhesive can leak from the lamp assembly, or flow from one region of the lamp in which the adhesive is desired to be located to a region of the lamp in which the adhesive can negatively impact lighting performance and/or cause lamp damage. Further, it has been determined that the use of adhesive can impact manufacturing yield. For example, during manufacturing adhesive glues can negatively impact, e.g., contaminate, the diffusive coating that may be present on the glass tube. Additionally, gluing the LED board to a glass tube including a diffusive coating has been the source for scratching of the diffusive coating. In some instances, the use of adhesives can also require an additional curing process, which increases the time of the manufacturing process that reduces yield.

It has further been determined that the use of adhesives in the manufacture of LED type tube lamps can result in device degradation due to thermal expansion effects, which can also effect the long-term reliability of the lamp. For example, lamp tubes and the corresponding light sources that are housed within the lamp tubes are elongated. Slight mismatches in the thermal expansion coefficient of the materials for the lamp tubes and the light source structures, e.g., circuit board to which LEDs are mounted, can result in delamination and product failure after many rounds of expansion and shrinking that results from temperature changes that occur during lamp operation.

Another disadvantage of conventional lamp tubes is that there is no registration point (fiducial mark) on the outer surface of the lamp tube. The failure to include a sufficient registration mark on the exterior of the lamp tube can result in misalignment of the pins for the end caps being installed on each end of the lamp tube. For example, the G13 pins can be mounted askew to the light source, e.g., LED board, and/or askew to each other at the opposing ends of the lamp tube.

In some embodiments, the methods and structures that are described herein can overcome the aforementioned deficiencies in glass tube light emitting diode (LED) lamp assemblies by providing a ridge (also referred to as tab structure) in the sidewall of the glass tube that has a geometry and dimension selected to retain the light source structure, e.g., circuit board including light emitting diodes (LEDs), such as, surface mount device (SMD) light emitting diodes (LEDs), within the hollow interior of the glass lamp tube without the use of adhesives. By providing a glass lamp tube having a sidewall geometry for retaining the light source structure, e.g., circuit board including light emitting diodes (LEDs), within the hollow interior of the glass lamp tube, the methods and structures described herein can eliminate the use of adhesives in LED lamp construction including glass tubes, i.e., glass lamp tubes. Eliminating adhesives LED lamp construction increases lamp manufacturing yield by eliminating uncontrolled adhesive flow, as well as eliminated the curing process/time required of the adhesive process. Further, by eliminating the adhesives, the methods and structures described herein can avoid any device degradation/failure that typically results from differences between thermal expansion of the glass lamp tube and the light source, e.g., light emitting diodes (LEDs) that are integrated with circuit boards.

Further, in some embodiments, when the light source is present on a circuit board that is retained between the ridges in the glass tube sidewall and a remaining portion of the glass tube sidewall proximate to the ridges in sliding engagement without adhesive, the methods and structures provide for easy reworking of the LED lamp tube structures. Additionally, the assembly process employing the glass lamp tubes including retaining ridges is easily suitable for process automation. In yet other embodiments, the retaining ridges in the sidewalls of the glass lamp tube can be used in combination with alignment tabs that are formed in the sidewalls of end caps to align the end caps with the glass lamp tube, and the light source being engaged to the glass lamp tube by the retaining ridges. The methods and structures that are provided herein are now described with more detail with reference to FIGS. 1A-16.

FIGS. 1A-3C depict a glass tube body 100, 100' including at least two ridges 50*a*, 50*b*, 50*c*, 50*d*, 50', 50", 50'" that extend along the length of the glass tube body 100, 100' from a first end E1 of the glass tube body 100, 100' continuously to a second end E2 of the glass tube body 100, 100'. In some embodiments, each of the at least two ridges 50*a*, 50*b*, 50*c*, 50*d*, 50', 50", 50'" extends continuously with uniform dimensions along a majority of the length L1 of the glass tube body 100, 100'. By "continuously" it is meant that each ridge contains no breaks, or discontinuous portions, from the start point to the end point of the ridge 50*a*, 50*b*, 50*c*, 50*d*, 50', 50", 50'" along the ridge's length with is parallel to the length L1 of the glass tube body 100, 100'. Although the ridge 50*a*, 50*b*, 50*c*, 50*d*, 50', 50", 50'" are depicted has extending continuously along the entirety of the length L1 of the glass tube body 100, other embodiments have been contemplated. For example, the ridges 50*a*, 50*b*, 50*c*, 50*d*, 50', 50", 50'" may extend along a majority of the length L1 of the glass tube body 100, 100' or greater. This means greater than half the length L1 of the glass tube body 100, 100'. In other examples, the ridges may extend along ½ the length L1 of the glass tube body; 9/16 the length L1 of the glass tube body 100, 100'; 5/8 the length L1 of the glass tube body 100; 21/32 the length L1 of the glass tube body 100; 11/16 the length L1 of the glass tube body 100, 100'; 21/32 the length L1 of the glass tube body 100, 100'; 3/4 the length L1 of the glass tube body 100; 25/32 the length L1 of the glass tube body 100, 100'; 13/16 the length L1 of the glass tube body 100; 7/8 the length L1 of the glass tube body 100, 100'; 15/16 the length L1 of the glass tube body 100; and the entire length L1 of the glass tube body, as well as any range of values using one of the aforementioned examples as a lower endpoint of the range and one of the aforementioned examples as an upper endpoint of the range. The term "uniform dimension", as used to describe how the ridges 50*a*, 50*b*, 50*c*, 50*d*, 50', 50", 50'" extend continuously with uniform dimensions along a majority of the length of the glass tube body 100, 100' means that the cross sectional geometry that is perpendicular to a length L1 of the glass tube body 100, 100' is the same, or substantially the same, for the ridge 50*a*, 50*b*, 50*c*, 50*d*, 50', 50", 50'" at each point along the ridge's continuous length for its entirety.

The glass tube body 100, 100' is composed of a glass composition. The term "glass" denotes the material of the lamp tube 100, 100' is composed of an amorphous solid material. The glass of the lamp tube body 100, 100' may be any of various amorphous materials formed from a melt by cooling to rigidity without crystallization, such as a transparent or translucent material composed of a mixture of silicates. In some embodiments, the glass composition used for the glass tube body 100, 100' is a soda lime silicate glass. In one example, the glass composition for the soda lime silicate glass that provides the glass of the glass tube body 100, 100' contains 60-75% silica, 12-18% soda, and 5-12% lime. In some other examples, such as in high temperature applications, the glass composition used for the glass lamp tube 100, 100' may be a borosilicate glass. Borosilicate glass is a silicate glass having at least 5% of boric oxide in its composition. It is noted that the above glass compositions are provided for illustrative purposes only, and are not intended to limit the glass tube body 100, 100' to only the compositions that are described above, as any glass composition is suitable for use with the glass tube body 100, 100'. The glass tube body 100, 100' does not include polymeric or plastic compositions.

Figure 1B:
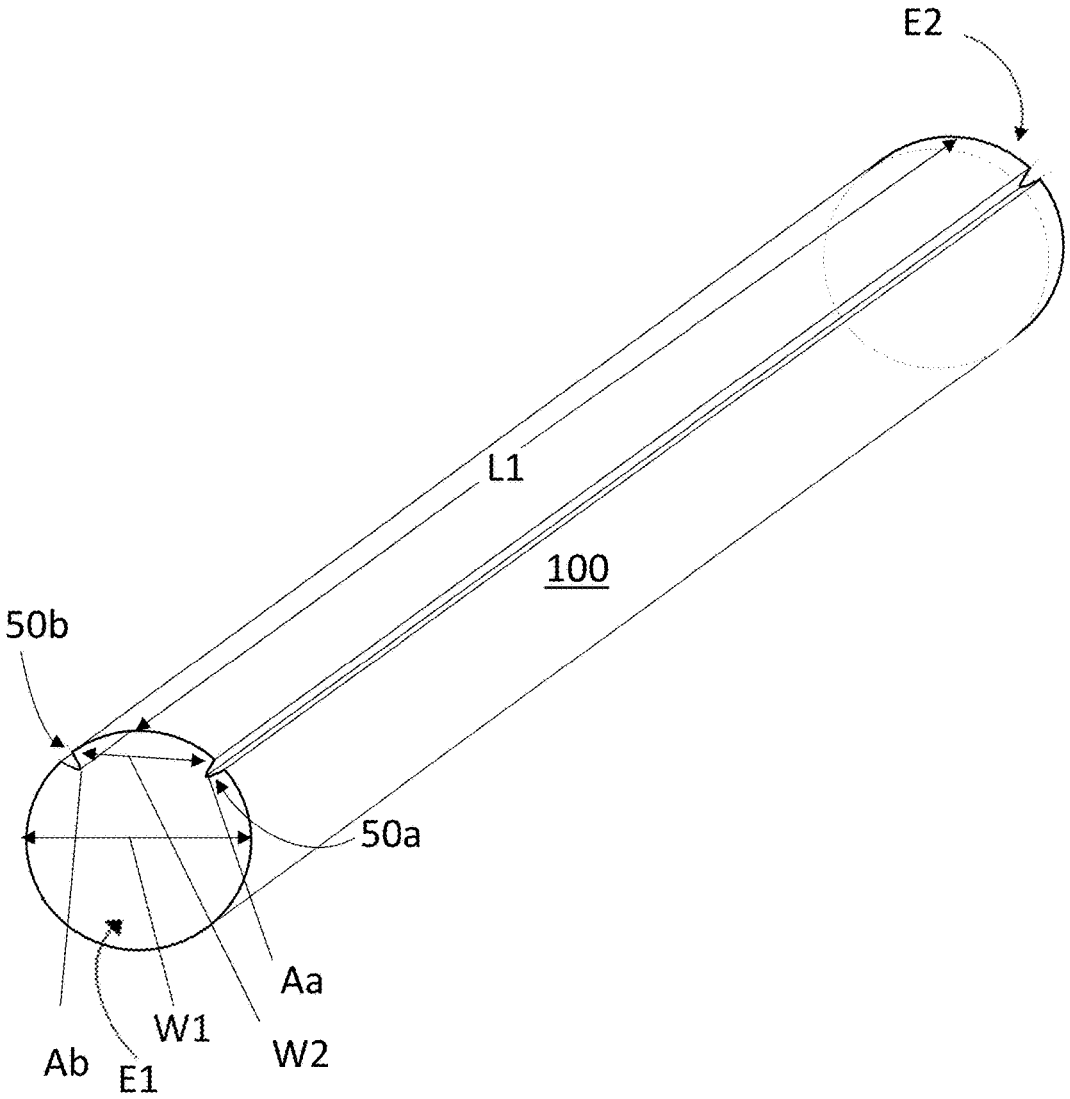
FIG. 1B is perspective view of the glass tube body that is depicted in FIG. 1A, in which the glass tube body has been rotated 180°.
Figure 2:
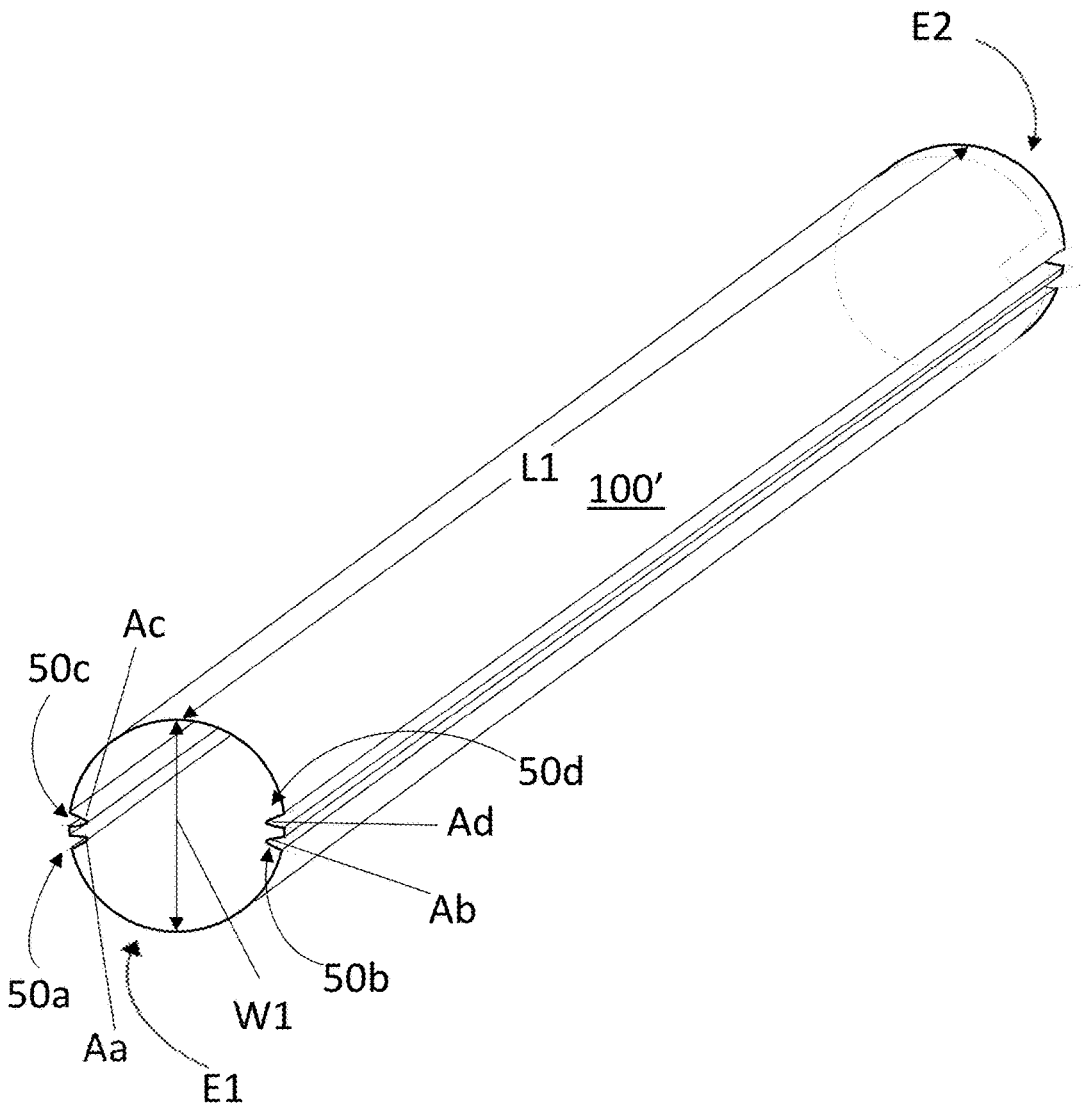
FIG. 2 is a perspective view of another embodiment of a glass tube body in accordance with the methods and structures described herein, wherein in this embodiment the glass tube body includes at least two ridges that extend the length of the glass tube body.

Referring to FIGS. 1A-2, in some embodiments, the glass tube body 100, 100' has a cross-sectional geometry that is perpendicular to a length L1 of the glass tube body 100, 100' with a substantially cylindrical perimeter defined by a sidewall of the glass tube body 100, 100' enclosing a hollow interior for housing a light source. The length L1 of the glass tube body 100, 100' extends from a first end E1 of the glass tube body 100, 100' for engagement by a first end cap 300*a* to a second end E2 of the glass tube body 100, 100' for engagement of a second end cap 300*a*. The length L1 of glass tube body 100, 100' is greater than a width W1 (diameter) of the glass tube body 100, 100'. In some embodiments, the length L1 of the glass tube body 100, 100' may range from 5" to 100", and the width W1, i.e., diameter, of the glass tube body 100, 100' may range from 0.5" to 2.0". In one embodiment, the thickness T1 of the glass sidewall for the glass tube body 100, 100' may range from 0.5 mm to 1.1 mm.

The dimensions, i.e., length L1 and width W1, of the glass tube body 100, 100' may be selected to be consistent with the standard sizes of T5, T8 and T12 fluorescent type lamps. For example, the length L1 and width W1 of the glass tube body 100, 100' may be selected to be consistent with the T5 standard for fluorescent type lamps. In this example, the glass tube body 100, 100' can have a width W1 (diameter) that is equal to 5/8", i.e., 0.625", and a length L1 that can be equal to 12", 24", 36", 48" or 60". In another example, the length L1 and width W1 of the glass tube body 100, 100' may be selected to be consistent with the T8 standard for fluorescent type lamps. In this example, the glass tube body 100, 100' can have a width W1 (diameter) that is equal to 8/8", i.e., 1.0", and a length L1 that can be equal to 12", 24", 36", 48" or 60". In yet another example, the length L1 and width W1 of the glass tube body 100, 100' may be selected to be consistent with the T12 standard for fluorescent type lamps. In this example, the glass tube body 100, 100' can have a width W1 (diameter) that is equal to 12/8", i.e., 1.5", and a length L1 that can be equal to 12", 24", 36", 48" or 60".

In some embodiments, the sidewall of the glass tube body 100, 100' that defines the substantially cylindrical perimeter includes at least two ridges 50*a*, 50*b*, 50*c*, 50*d* on opposing sides of the substantially cylindrical perimeter, wherein at each ridge 50*a*, 50*b*, 50*c*, 50*d* of said at least one pair of the ridges comprises an apex Aa, Ab, Ac, Ad extending in a direction towards the hollow interior for the glass tube body 100, 100'. The glass tube body 100, 100' includes a first opening at a first end E1 of the glass tube body 100, 100' and a second opening at a second end E2 of the glass tube body 100, 100', wherein each of the first and second openings E1, E2 extend to the hollow interior of the glass tube body 100, 100' that houses the light source of the lamp. In some embodiments, the at least two ridges 50*a*, 50, 50*c*, 50*d* that are present in the sidewalls of the glass tube body 100, 100' function to retain edges E3, E4 of an electronics board 200 including the light source between each of the pair of ridges and a portion of the sidewall of the glass tube body 100, 100'. The ridges 50*a*, 50*b*, 50*c*, 50*d* extend continuously along the entire length L1 of the glass tube body 100, 100'.

FIGS. 1A and 1B depict one embodiment of a glass tube body 100 including at least two ridges 50*a*, 50*b* that extend along the length L1 of the glass tube body 100 from a first end E1 of the glass tube 100 continuously to a second end E1 of the glass tube. In the embodiment that is depicted in FIGS. 1A and 1B, a light source 200 including a circuit board 203 having at least one light emitting diode (LED) 201 is retained within the hollow interior of the glass tube body 100 by sliding engagement between the pair of ridges 50*a*, 50*b*. More specifically, the edges of the circuit board 203 are retained between the pair of ridges 50*a*, 50*b* (provided by the at least two ridges) and a portion of the glass tube sidewall extending from a first ridge 50*a* to a second ridge 50*b* of the at least one pair of ridges 50*a*, 50*b*. This is more clearly depicted in FIG. 6B. FIG. 1B is perspective view of the glass tube body 100 that is depicted in FIG. 1A, in which the glass tube body 100 has been rotated 180° to more clearly depict how the ridges 50*a* (50*b* is on the opposing side of the depicted ridge 50*a*) extend continuously along the entire length L1 of the glass tube body 100.

Referring to FIGS. 1A-1B, the first ridge 50*a* and the second ridge 50*b* of the at least two ridges 50*a*, 50*b* are separated by a width dimension W2 across the glass tube body 100 ranging from 6 inches to 96 inches. This dimension is selected to retain the substrate for the light source, e.g., circuit board having light emitting diodes (LEDs) present thereon. The retaining width dimension W2 extends from the curvature at the base of a first retaining ridge 50*a* across the hollow interior of the glass tube body 100 to the curvature at the base of the second retaining ridge 50*b*. The retaining width dimension W2 is substantially equal to the width of the face of the substrate of the light source from which light is being emitted, e.g., the surface of the circuit board on which the surface mount device (SMD) light emitting diodes (LEDs) are present.

FIG. 2 depicts another embodiment of a glass tube body 100' in accordance with the methods and structures described herein. In the embodiment of the glass tube body 100' that is depicted in FIG. 2, the sidewall of the glass tube body 100' includes two pair of ridges 50*a*, 50*b*, 50*c*, 50*d* that extend the length L1 of the glass tube body 100'. In the embodiment that is depicted in FIG. 2, a light source 200 including a circuit board 203 having at least one light emitting diode (LED) 20 is retained within the hollow interior of the glass tube body 100 by sliding engagement between the two pair of ridges 50*a*, 50*b*, 50*c*, 50*d*. This is described in more detail with reference to FIG. 6C. In some embodiments, a first pair of ridges 50*c*, 50*d* contacts an upper surface of the circuit board 203 including the light emitting diodes (LEDs) 201, and a second pair of ridges 50*a*, 50*b* contacts a lower surface of the circuit board 203 of the light source 200 to retain the circuit board 203 between the two pairs of ridges 50*a*, 50*b*, 50*c*, 50*d*.

Figure 3A:
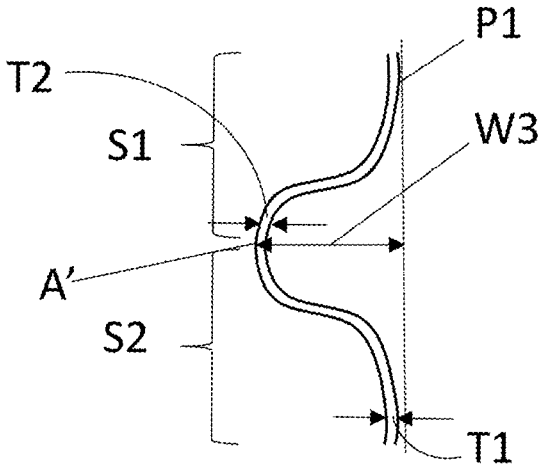
FIG. 3A is a side cross-sectional view of a portion of a glass tube body sidewall having a ridge present therein, in which the ridge is composed of two opposing sigmoidal (sigmoidal means s-shaped) shaped glass ridge sidewall portions of the glass tube body that converge at an apex to provide the ridges, in accordance with one embodiment of the present disclosure.
Figure 3B:
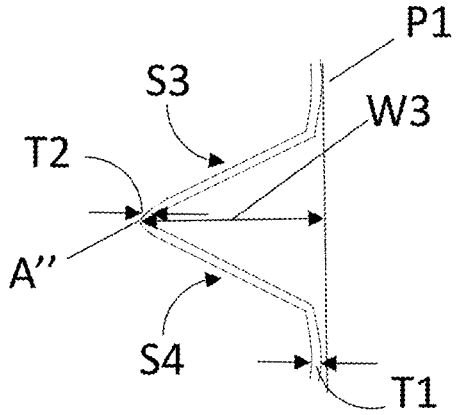
FIG. 3B is a side cross-sectional view of a portion of a glass tube body sidewall having another embodiment of a ridge present therein, in which the ridge is composed of two substantially planar sidewalls that are converging to an apex, in accordance with another embodiment of the present disclosure.
Figure 3C:
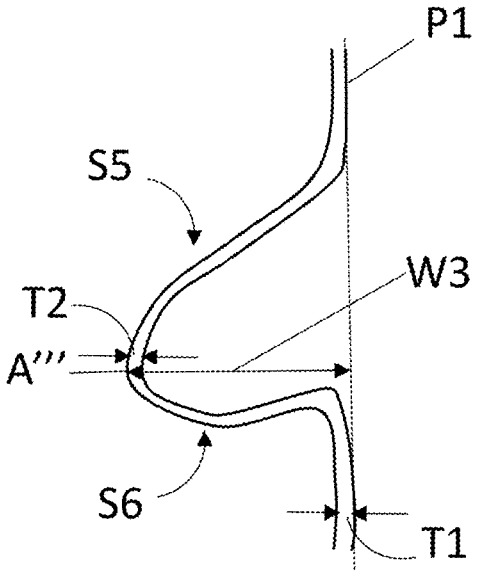
FIG. 3C is a side cross-sectional view of a portion of a glass tube body sidewall having another embodiment of a ridge present therein, wherein the apex of the ridge is shaped in a hook type geometry.

FIGS. 3A-3C illustrate some embodiments for the geometry of a single ridge 50', 50", 50'" in a portion of a sidewall of a glass tube body 100. The examples of the single ridges 50', 50", 50'" that are depicted in FIGS. 3A-3C can be employed for each of the at least two ridges 50*a*, 50*b* (also referred to as single pair of ridges 50*a*, 50*b*) that are depicted in FIGS. 1A-1B, and can be employed for each of the four ridges 50*a*, 50*b*, 50*c*, 50*d* in the two pairs of ridges 50*a*, 50*b*, 50*c*, 50*d*. Each of the at least two ridges 50', 50", 50'" can be employed for each ridge in the first pair of ridges 50*c*, 50*d*, and/or each of the pair of ridges 50', 50", 50'" can be employed for each ridge in the second pair of ridges 50*a*, 50*b* The protruding width W1 is measured from a plane P1 extending from a first portion, i.e., uppermost height of the ridge 50', 50", 50'", of the outside sidewall of the glass tube body 100 at which the curvature begins for the ridge 50', 50", 50'" at a first end of the height of the ridge 50', 50", 50'" to a second portion of the outside sidewall of the glass tube body 100 at which the curvature for the ridge 50', 50", 50'" ends, i.e., base of the height of the ridge 50', 50", 50'". The protruding width W3 dimension extends from the plane P1 to an apex A', A", A'" of the ridge 50', 50", 50'" in a direction that is perpendicular to the plane P1 depicted in FIGS. 3A-3C. The apex A', A", A'" of the ridges depicted in FIGS. 3A-3C are equivalent to the apex Aa, Ab, Ac, Ad that are depicted in FIGS. 1A-2. In one example, each of the ridges 50', 50", 50'" has a protruding width W3 towards the hollow body of the glass tube body 100 that ranges from 1/10 a width of the glass tube body 100 to 1/5 the width of the glass tube body 100. In some embodiments, from the perspective of the hollow interior of the glass tube body 100, the apex A', A", A'" of the ridges 50', 50", 50'" is present at a peak of a convex curvature in the sidewall of the glass tube body 100 towards a center of the hollow interior for the glass tube body 100.

FIG. 3A is a side cross-sectional view of a portion of a glass tube body 100 having a ridge 50' present therein, in which the ridge 50' is composed of two opposing sigmoidal (sigmoidal means s-shaped) shaped glass ridge sidewall portions S1, S2 of the glass tube body 100 that converge at an apex A'. In the embodiment that is depicted in FIG. 3A, the first sigmoidal shaped glass ridge sidewall portion S1 beginning at the height of the ridge 50' and extending to the apex A', has a geometry that is consistent with an inverted image of the second sigmoidal shaped glass ridge sidewall portion S2 that begins at the base of the height of the ridge 50' and extends to the apex A'.

FIG. 3B is a side cross-sectional view of a portion of a glass tube body sidewall having another embodiment of a ridge 50" present therein, in which the ridge 50" is composed of two substantially planar sidewalls S3, S4 that are converging to an apex A", in accordance with another embodiment of the present disclosure. The substantially planar sidewalls S3, S4 are linear for the majority of their height.

FIG. 3C is a side cross-sectional view of a portion of a glass tube body sidewall having another embodiment of a ridge 50'" present therein, wherein the apex A'" of the ridge 50'" is shaped in a hook type geometry. In the embodiment that is depicted in FIG. 3C, the sidewalls S5, S6 are curved, but the curvature of the sidewall S5 that begins at the height of the ridge 50'" is different from the curvature S6 that begins at the base of the ridge 50'". In the embodiment, of the ridge 50'" that is depicted in FIG. 3C, the first sigmoidal shaped glass ridge sidewall portion 51 beginning at the height of the ridge 50' and extending to the apex A'", has a geometry that is not consistent with an inverted image of the second sigmoidal shaped glass ridge sidewall portion S6 that begins at the base of the height of the ridge 50'" and extends to the apex A'". In some embodiments, the hook geometry that is depicted in FIG. 3C may be inverted so that the apex A'" of the hook is pointing upward, as opposed to pointing downward as depicted in FIG. 3C.

Referring to FIGS. 1A-3C, the thickness T1, T2 for the sidewall of the glass tube body 100 is substantially uniform at the ridges 50*a*, 50*b*, 50*c*, 50*d*, 50', 50", 50'" (identified by T2), and a remainder of the sidewall of the sidewall (identified by T1) of the glass tube body 100 that does not include the pair of ridges 50*a*, 50*b*, 50*c*, 50*d*, 50', 50", 50'". For example, the thickness of the sidewall of the glass tube body 100 at each of the ridges 50*a*, 50*b*, 50*c*, 50*d*, 50', 50", 50'" can range from 0.5 mm to 1.1 mm, and the thickness of the remainder of the sidewall of the sidewall of the glass tube body 100 that does not include the pair of ridges 50*a*, 50*b*, 50*c*, 50*d*, 50', 50", 50'" can range from 0.5 mm to 1.1 mm. This means that the thickness of the sidewall of the glass tube body 100 at the portions that provides the ridges 50*a*, 50*b*, 50*c*, 50*d*, 50', 50", 50'" is substantially the same, e.g., within +/−5%, of the thickness of the remainder of the sidewall of the sidewall of the glass tube body 100 that does not include the pair of ridges 50*a*, 50*b*, 50*c*, 50*d*, 50', 50", 50'".

In some embodiments, the substantial uniformity in the sidewall of the glass tube body 100, 100' at the portions that provide the ridges 50*a*, 50*b*, 50*c*, 50*d*, 50', 50", 50'" means that from a perspective of an exterior of the glass tube body 100 that divots (corresponding to the inward extending ridges) are present along the length of the glass tube body. From a perspective of an exterior of the glass tube body 100, 100', the divots have a concave curvature extending into the glass tube's hollow interior. If the retaining ridges 50*a*, 50*b*, 50*c*, 50*d*, 50', 50", 50'" are referred to as being present on the interior sidewalls of the glass tube body 100, 100', the divots are present on the exterior sidewalls of the glass tube body 100, 100'.

The divots formed in the exterior sidewall of the glass tube body 100, 100' extend the entire length L1 of the glass tube body 100, 100' to each end E1, E2 of the glass tube body 100, 100'. In some embodiments, similar to the ridges 50*a*, 50*b*, 50*c*, 50*d*, 50', 50", 50'", the divots are continuous structures having a uniform dimensions, e.g., uniform cross sectional geometry, along their entire length. In some embodiments, from a perspective viewing an exterior surface of the sidewall of the glass tube body 100, 100' (viewing the exterior sidewall from a point exterior to the glass tube body), a divot is present corresponding to each ridge, in which the divot has a concave curvature extending towards the hollow interior for the glass tube body. The sidewall thickness T2 of the glass tube body 100, 100' at portions including each ridge (and each divot corresponding to each ridge) is substantially equal to a sidewall thickness T1 of the glass tube body 100, 100' at remaining portions that do not include the ridges (and each divot corresponding to said each ridge), as depicted in FIGS. 3A-3C. This is differentiated from a structure having a greater thickness sidewall at the retaining ridge portions of the glass tube body than a thinner sidewall remainder of the glass tube body that does not include the retaining ridges.

The divots at each end E1, E2 of the glass tube body 100, 100' may be engaged by alignment tabs in the sidewalls of end caps 300*a*, 300*b* having contacts providing electrical communication between a lamp fixture and an LED driver 202 of the lamp 500 including the glass tube body 100, 100' and the light source 200. The end caps 300*a*, 300*b* are depicted in more detail in FIGS. 8A and 8B. The alignment tabs in the end caps 300*a*, 300*b* can provide for alignment between the end cap contacts and the light tube body 100, 100', as well as alignment to the light source 200 positioned by the retaining ridges 50*a*, 50*b*, 50*c*, 50', 50", 50'" within the hollow interior of the glass tube body 100, 100'.

The glass tube body 100, 100' that is depicted in FIGS. 1A-3 is composed of a unitary structure of a single composition glass.

FIGS. 4-7 and 9 depict one embodiment of a lamp 500 that includes a glass tube body 100, 100' having a cross-sectional geometry that is perpendicular to a length L1 of the glass tube body 100, 100' with a substantially cylindrical perimeter defined by a sidewall of the glass tube body 100, 100' enclosing a hollow interior. Some embodiments of the glass tube body 100, 100' for the lamp 500 have been described above with reference to FIGS. 1A-3C, in which the sidewall of the glass tube body 100 defines the substantially cylindrical perimeter including at least two ridges 50*a*, 50*b*, 50*c*, 50*d*, 50', 50", 50'" on opposing sides of the substantially cylindrical perimeter. The above description of the glass tube body 100, 100' provided with reference to FIGS. 1A-3C is suitable for providing the description of at least some embodiments of the glass tube body 100, 100' of the lamp 500 that is described with reference to FIGS. 4-7 and 9.

The lamp 500 further includes a light source 200 present within the hollow interior of the glass tube body 100, 100' in which the light source 200 includes a substrate 203 having edges E3, E4, E5, E6 in between the at least one pair of ridges 50*a*, 50*b*, 50*c*, 50*d*, 50', 50", 50'" and a portion of the sidewall of the glass tube body 100. In the embodiments depicted in FIGS. 4-7 and 9, the light source 200 is provided by a light emitting diode (LED) 201 and the substrate 203 is a circuit board, e.g., printed circuit board (PCB), on which the LEDs 201 are mounted as surface mount devices (SMDs). Although other light sources and substrates are suitable for use with the glass tube body 100, 100' that is described herein in providing a lamp 500, the light source 200 is specifically referred to as having light emitting diodes 201, and the substrate 203 is hereafter referred to as a circuit board 203, e.g., printed circuit board. For example, in addition to semiconductor type light emitting diodes (LEDs), the light source may be organic light emitting diodes, laser diodes or any like light source.

Figure 4:
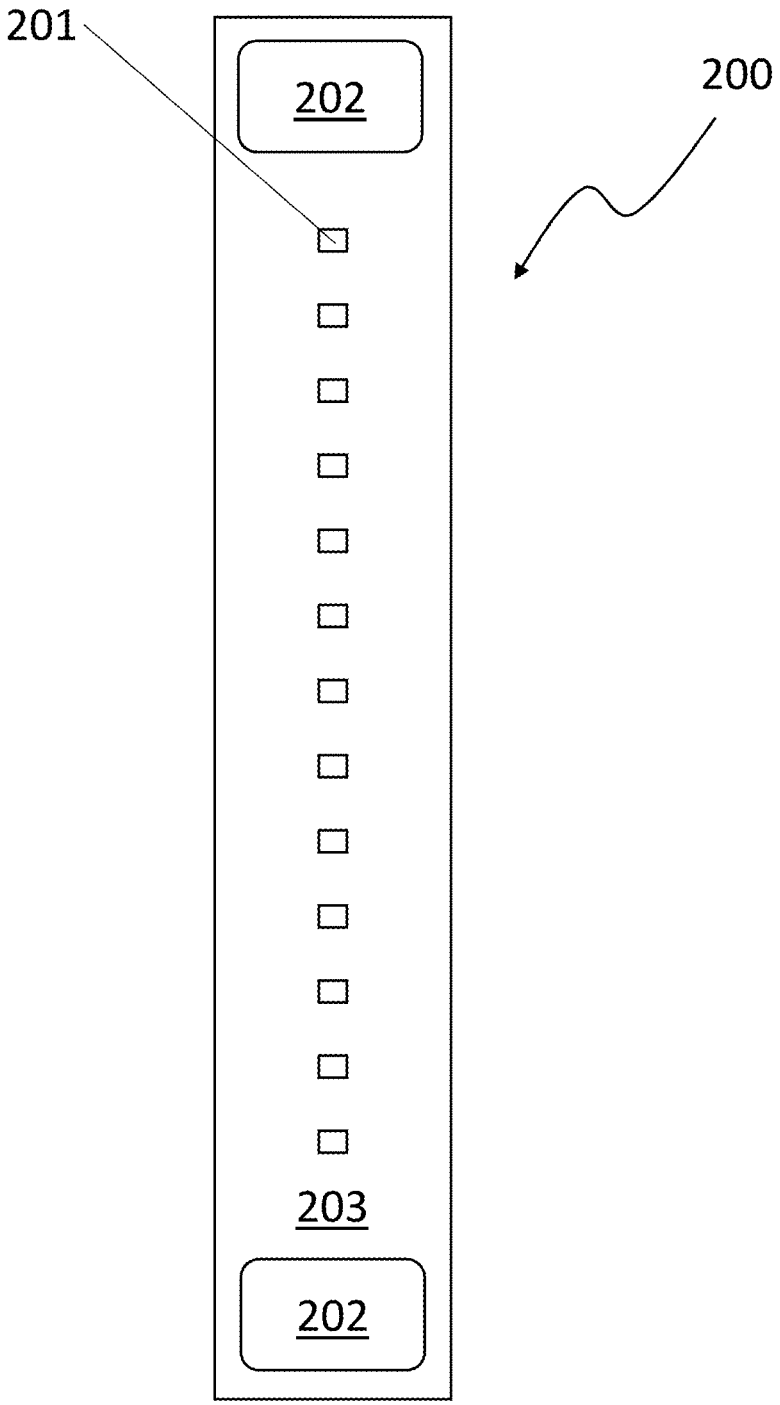
FIG. 4 is a top down view of a light source that can be housed within the glass lamp tube that is depicted in FIGS. 1A-3C, in which the light source includes a plurality of surface mount device (SMD) light emitting diode (LED) present on a circuit board, in accordance with at least one embodiment of the present disclosure.

FIG. 4 is a top down view of a light source 200 that can be housed within the glass tube body 10, 100' that is depicted in FIGS. 1A-3C, in which the light source 200 includes a plurality of light emitting diodes (LEDs) 201, e.g., surface mount device (SMD) light emitting diodes (LED), that are present on a circuit board 203, e.g., printed circuit board. A light emitting diode (LED) 201 is a light source that can be a semiconductor device that emits visible light when an electric current passes through it. The LEDs 201 of the light source 200 can include at least one LED 201, a plurality of series-connected or parallel-connected LEDs 201, or an LED array 201. At least one LED array for the light source 200 can include a plurality of LED arrays. In the embodiment that is depicted in FIG. 4, the LEDs 201 are arranged in three columns, but it is not intended that an array of LEDs 201 be limited to only this arrangement. For example, the LEDs 201 may also be arranged in a single column that extends along a majority of the length of the circuit board 203.

Any type of LED may be used in the LEDs 201 of the light source 200. For example, the LEDs 201 of the light source 200 can be semiconductor LEDs, organic light emitting diodes (OLEDs), semiconductor dies that produce light in response to current, light emitting polymers, electroluminescent strips (EL) or the like. The LEDs 201 can be mounted to the circuit board 203 by solder, a snap-fit connection, or other engagement mechanisms. In some examples, the LEDs 201 are provided by a plurality of surface mount discharge (SMD) light emitting diodes (LED) arranged in a plurality of lines on the circuit board 203.

In some embodiments, the LEDs 201 of the light source 200 can produce white light. However, LEDs 201 that produce blue light, purple light, red light, green light, ultra-violet light, near ultra-violet light, or other wavelengths of light can be used in place of white light emitting LEDs 201. In some embodiments, the emission wavelengths for the LEDs 201 of the light source 200 can range from approximately 400 nm to approximately 470 nm, or the emission wavelengths for the LEDs 201 of the light source 200 can range from approximately 300 nm to approximately 400 nm.

The number of LEDs 201 for the light source 200 can be a function of the desired power of the lamp 500 and the power of the LEDs 201. For example, for a 48" lamp 500, the number of LEDs 201 that are present on the circuit board 203 of the light source can vary from about 5 LEDs 201 to about 400 LEDs 201, such that the lamp 500 outputs approximately 500 lumens to approximately 3,000 lumens.

The LEDs 201 for the light source 200 can be mounted on a circuit board 203, such as a printed circuit board (PCB). A printed circuit board (PCB) mechanically supports and electrically connects electronic components, such as the LEDs 201 and the driving electronics 202, using conductive tracks, pads and other features etched from copper sheets laminated onto a non-conductive substrate. The printed circuit board 203 is typically composed of a dielectric material. For example, the circuit board may be composed of fiber-reinforced plastic (FRP) (also called fiber-reinforced polymer, or fiber-reinforced plastic) is a composite material made of a polymer matrix reinforced with fibers. The fibers are usually glass, carbon, aramid, or basalt. The polymer is usually an epoxy, vinylester, or polyester thermosetting plastic, though phenol formaldehyde resins are still in use. In some embodiments, the printed circuit board (PCB) is composed of a composite consistent with the above description that is called FR-4. The width of the printed circuit board 203 is selected to provide sliding fitment with the retaining ridges 50*a*, 50*b*, 50*c*, 50', 50", 50'" that are depicted in FIGS. 1A-3C. The length of the printed circuit board 203 is selected to fit within the length L1 of the glass tube housing 100, and to provide the appropriate number of LEDs 21 for the lamp 500. The printed circuit board 203 is not limited to the example shown in the figures. The printed circuit board 203 may be made in one piece or in longitudinal sections joined by electrical bridge connectors.

Still referring to FIG. 4, the printed circuit board 203 may further include an internal built in ballast, i.e., LED driver 202, and printed circuitry providing electrical communication between the ballast and the LEDs 201, e.g., surface mount discharge (SMD) light emitting diodes (LED). The LED driver 202 is an electrical device which regulates the power to the LED 201, or a string (or strings) of LEDs 201. In some embodiments, the LED driver 202 responds to the changing needs of the LEDs 201, or LED circuit, by providing a constant quantity of power to the LED 201 as its electrical properties change with temperature. In some embodiments, an LED driver 202 is a self-contained power supply which has outputs that are matched to the electrical characteristics of the LED or LEDs 201. In some embodiments, the LED driver 202 may offer dimming by means of pulse width modulation circuits and may have more than one channel for separate control of different LEDs or LED arrays 201. The power level of the LED 201 is maintained constant by the LED driver 202 as the electrical properties change throughout the temperature increases and decreases seen by the LED or LEDs 201. In some embodiments, the supply voltage of the LED driver 202 may be equal to 2.3V to 5.5 V, 2.7V to 5.5 V and/or 3V to 5.5 V. In some embodiments, the output current per channel that can be provided by the LED driver 202 can be between 250 μA and 50 A. In some other embodiments, the LED driver 202 can have an output current per channel ranging from 20 mA to 100 mA, e.g., 25 mA.

Figure 5:
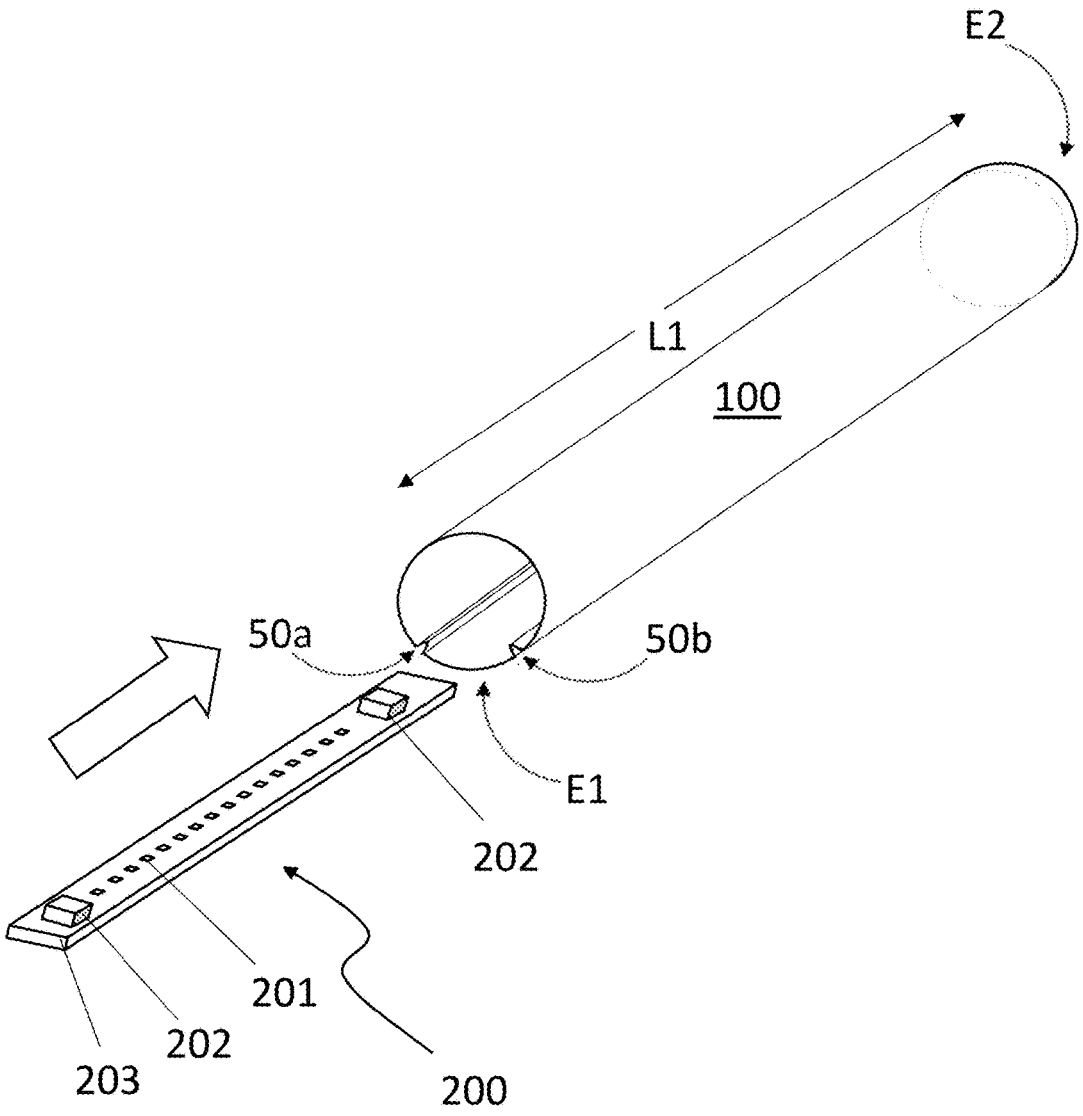
FIG. 5 is a perspective view illustrating sliding a circuit board including at least one light source along the at least one pair of ridges to position a circuit board including at least one light source into a hollow interior of a glass tube body, in accordance with one embodiment of the present disclosure.
Figure 6A:
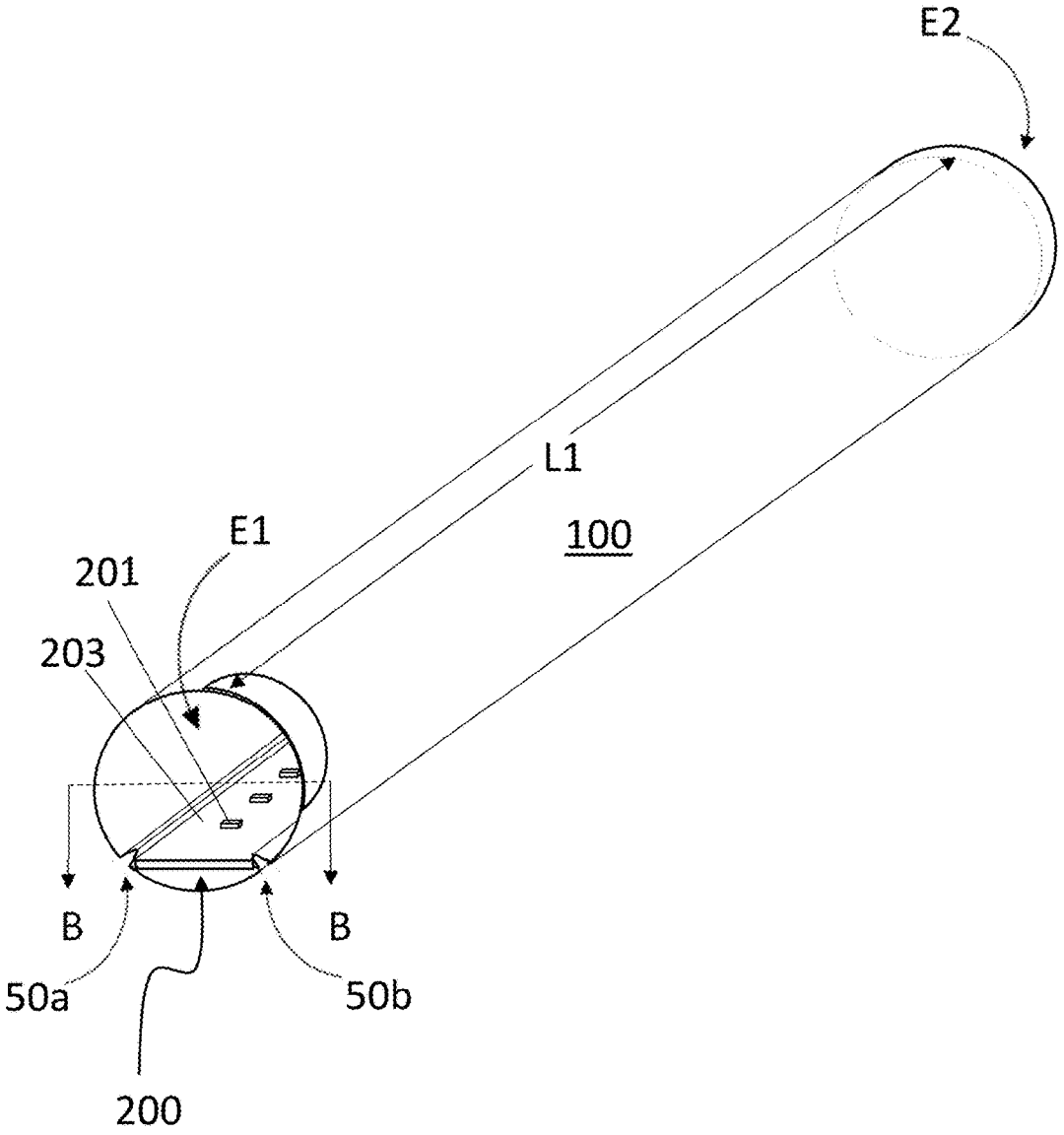
FIG. 6A is a perspective view illustrating one embodiment of a light source present on a circuit board engaged to a glass tube body, in which the edges of the circuit board are retained without using an adhesive between the at least two ridges and a portion of the glass tube sidewall extending from a first ridge to a second ridge of the at least two ridges, in accordance with the present disclosure.
Figure 6B:
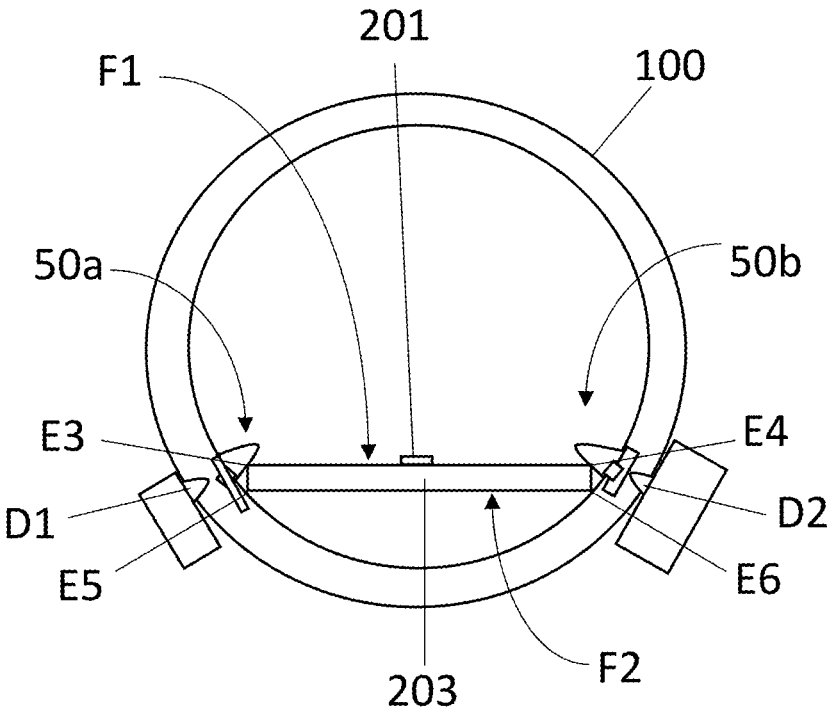
FIG. 6B is a side cross-sectional view along section line B-B of the assembly depicted in FIG. 6A, in which a light source housed on a circuit board is engaged to a glass lamp tube body through a retaining contact with of the at least two ridges that are present in the sidewall of the glass tube body.
Figure 6C:
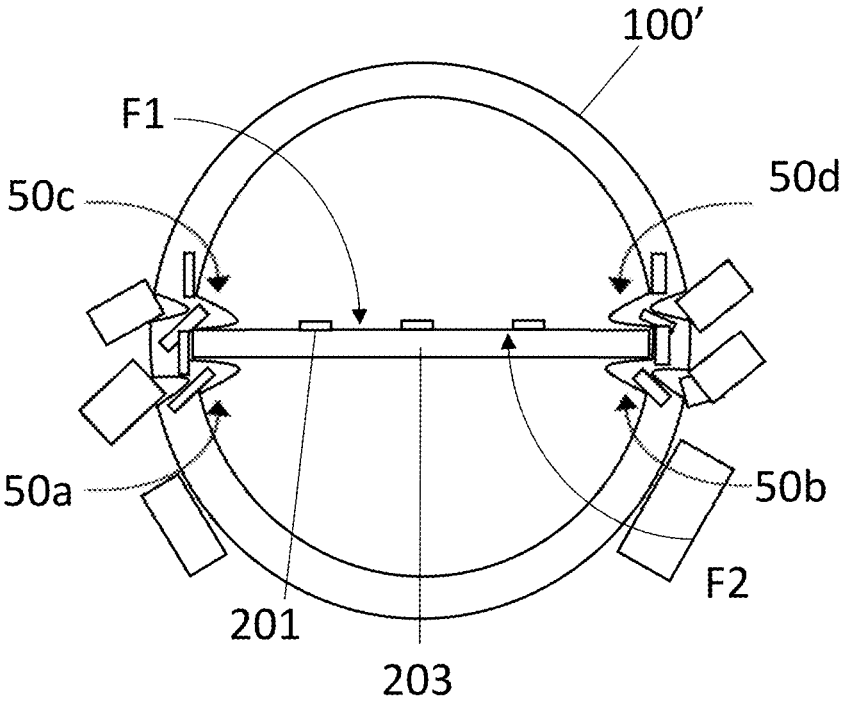
FIG. 6C is a side cross-sectional view of another embodiment of an assembly including a glass lamp tube body and light source housed on a circuit board, in which the light source/circuit board is engaged to the glass lamp tube body through retaining contact with at least two pairs of ridges that are present in the sidewalls of the glass tube body without the use of adhesive.

FIGS. 5-6C illustrate some embodiments of the light source 200 depicted in FIG. 4 being inserted into the hollow interior of a glass tube body 100, 100' for providing the lamp 500, in which the glass tube body 100, 100' surrounds the light source 200.

In one aspect of the present disclosure, a method of assembling a lamp 500 is provided. The assembly method may include providing a glass tube body 100, 100' (as described with reference to FIGS. 1A-3) having a cross-sectional geometry that is perpendicular to a length L1 of the glass tube body 100, 100' with a substantially cylindrical perimeter defined by a sidewall of the glass tube body 100, 100' enclosing a hollow interior for housing a light source 200 (as described with reference to FIG. 4). In one embodiment, the sidewall of the glass tube body 100, 100' that defines the substantially cylindrical perimeter has at least two ridges 50*a*, 50*b*, 50*c*, 50*d*, 50', 50", 50'" on opposing sides of the substantially cylindrical perimeter.

Referring to FIG. 5, in one embodiment, the assembly method includes sliding a printed circuit board 203 of the light source 200 including LEDs 201 in a direction D1 through the first end E1 of the glass tube body 100 along the at least one pair of ridges 50*a*, 50*b* to position the circuit board 203 including the LEDs 201 into the hollow interior of the glass tube body 100. In the embodiment depicted in FIG. 5, the glass tube body 100 includes a single pair of ridges 50*a*, 50*b* as depicted in FIGS. 1A-1B.

FIG. 6A is a perspective view illustrating one embodiment of a light source 200 including LEDs 201 being positioned within the hollow interior of the glass tube body 100 following the sliding insertion of the printed circuit board 203 along the ridges 50*a*, 50*b* of the glass tube sidewalls through the first end E1 of the glass tube body 100, as depicted in FIG. 5. As depicted in FIG. 6A, the edges of the circuit board 203 containing the LEDs 201 for the light source 200 are retained between the at least one pair of ridges 50*a*, 50*b*, and a portion of the glass tube sidewall extending from a first ridge 50*a* to a second ridge 50*b* of the at least two ridges 50*a*, 50*b*. In some embodiments, the light source 200 including the LEDs 201 that are present on the circuit board 203 is engaged to a glass tube body 100 depicted in FIG. 6A without using an adhesive.

The engagement of the printed circuit board 203 including the LEDs 201 for the light source 200 to the retaining ridges 50*a*, 50*b* of the glass tube body 100 (as illustrated by FIGS. 1A-1B) is depicted in greater detail in FIG. 6B. FIG. 6B is a side cross-sectional view along section line B-B of the assembly depicted in FIG. 6A, in which a light source 200 housed on the printed circuit board 203 is engaged to a glass tube body 100 through a retaining contact with at least two ridges 50*a*, 50*b*, e.g., a single pair of ridges 50*a*, 50*b*, that are present in the sidewall of the glass tube body 100.

In some embodiments, the printed circuit board 203 including the surface mount discharge (SMD) light emitting diodes (LED) 201 is engaged to the glass tube body 100 by a first set of fitment contacts between a first edge E3 of a light emission face F1 of the printed circuit board 203 to a first ridge 50*a* of the pair of ridges 50*a*, 50*b*, and a second edge E4 of the light emission face F1 of the printed circuit board 203 to a second ridge 50*b* of the pair of ridges 50*a*, 50*b*. The light emission face F1 of the printed circuit board 203 is the circuit of the board on which the light emitting diodes (LEDs) 201, e.g., surface mount device (SMD) light emitting diode (LED), is present. The light emission face F1 is the surface of the light source 200 from which light is emitted. Simultaneous with the set of first fitment contacts between the retaining ridges 50*a*, 50*b* and the light emission face F1, a second set of fitment contacts is present between a third edge E5 of a back face F2 of the printed circuit board 203, and a fourth edge E6 of the back face F2 of the printed circuit board 203, with portions of the sidewall of the glass tube body 100 that extends from a first ridge 50*a* on one side of the glass tube body 100 to a second ridge 50*b* on an opposing second side of the glass tube body 100. The back face F2 of the printed circuit board 203 is opposite the light emission face F1. The back face F2 typically does not include light emitting diodes (LEDs). In some embodiments, the LED driver 202 can be mounted to the back face F2 of the printed circuit board 203. In some other embodiments, a heat sink, such as a metal plate composed of aluminum or copper, is connected to the back face F2 of the printed circuit board 203.

The combination of the first and second set of fitment contacts between the retaining ridges 50*a*, 50*b*, printed circuit board 203 and the sidewall of the glass tube body 100 retains the light source 200 within the hollow interior of the glass tube body 100 without any adhesive.

Although FIGS. 5-6B depict the use of a glass tube body 100 including a single pair of retaining ridges 50*a*, 50*b*, the method of assembly including the sliding insertion of the printed circuit board 203 including the LEDs 201 into the hollow interior of the glass tube body 100 is also applicable to the glass tube body 100' including two sets of retaining ridges 50*a*, 50*b*, 50*c*, 50*d* that has been described above with reference to FIG. 2.

FIG. 6C illustrates one embodiment of an assembly for providing a lamp 500 that includes a glass tube body 100' and a light source 200, e.g., a light source 200 that is provided by LEDs 201 that are housed on a printed circuit board 203, in which the light source 200, e.g., circuit board 203, is engaged to the glass tube body 100' through retaining contact with at least two pairs of ridges 50*a*, 50*b*, 50*c*, 50*d* that are present in the sidewalls of the glass tube body 100'. The two pairs of ridges 50*a*, 50*b*, 50*c* 50*d* retain the light source 200 within the hollow interior of the glass tube body 100'. For example, a first pair of ridges 50*c*, 50*d* contacts a light emission face F1 of the printed circuit board 203 having the light emitting diodes (LEDs), and a second pair of ridges 50*a*, 50*b* contacts a back face F2 of printed circuit board 203 to retain the printed circuit board 203 between the two pairs of ridges 50*a*, 50*b*, 50*c*, 50*d*.

In some embodiments, once the assembly of the light source 200 and the glass tube body 100, 100' has been provided, end caps 300 may be positioned on each end of the glass tube body 100, 100' having electrical contacts for communication between a lamp fixture and the LED driver 202 of the light source 200, hence providing a lamp 500.

Figure 7:
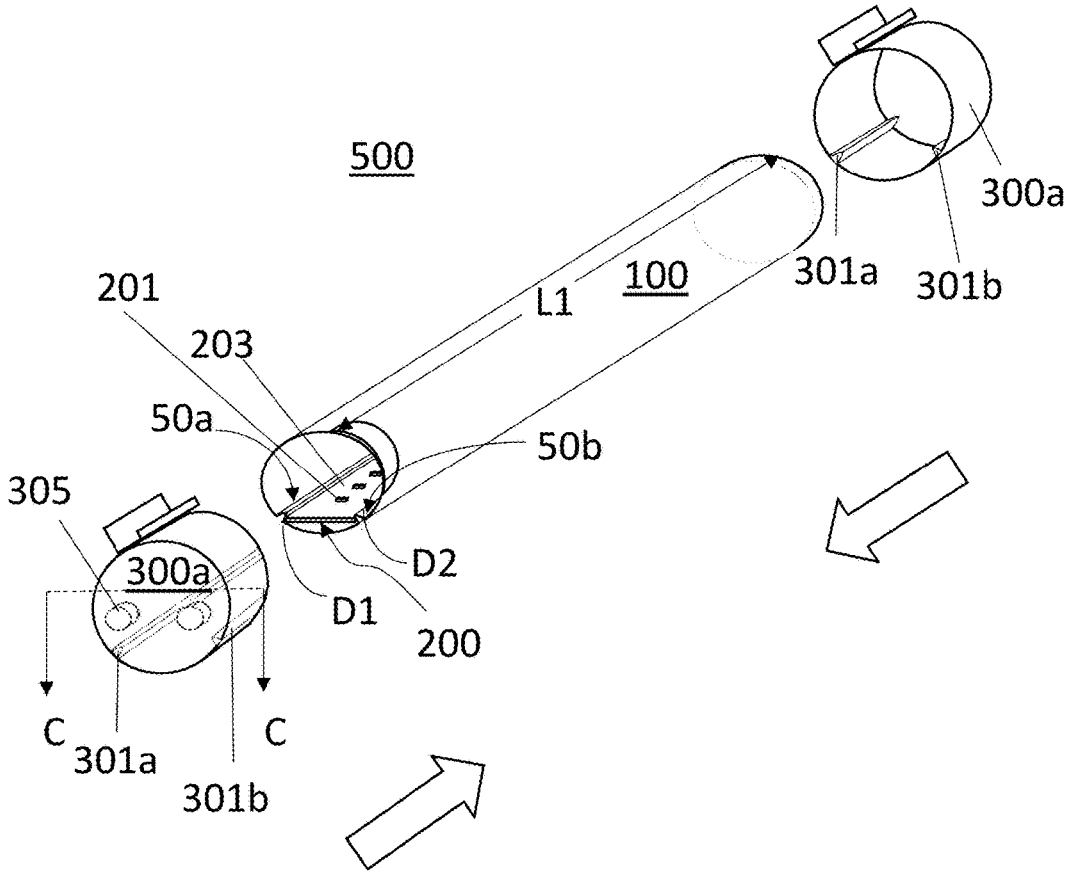
FIG. 7 is a side cross sectional view depicting installing end caps having electrical contacts for electrical communication with a lamp fixture to the glass lamp tube that is depicted in FIG. 6A, in which each of the end caps have alignment tabs for engagement to the at least two ridges at the opposing first and second ends of the glass tube body.

FIG. 7 depicts one embodiment of installing end caps 300*a*, 300*b* having electrical contacts 305 for electrical communication with a lamp fixture to the assembly of the glass lamp tube 100 and light source 200 that is depicted in FIGS. 6A and 6B, in which each of the end caps 300*a* have alignment tabs 301*a*, 301*b* for engagement to the at least one pair of ridges 50*a*, 50*b*, i.e., face of the ridges 50*a*, 50*b* that provides divots D1, D2, at the opposing first and second ends E1, E2 of the glass tube body 100.

In some embodiments, each of the end caps 300*a* are composed of a polymeric material, such as silicone; a metal material, such as aluminum, or a combination, i.e., assembly, thereof. The end caps 300*a* have a sidewall having a diameter and geometry that is sufficient to fit over the ends E1, E2 of the glass tube body 100. For example, the majority of the cross-section of the end caps 300*a*, 300*b* can be substantially circular matching the cross-section of the glass tube body 100.

Additionally, the sidewalls of the end caps 300*a* have alignment tabs 301*a*, 301*b* having a geometry and dimension that fits within the divots D1, D2 formed in the exterior sidewalls of the glass tube body 100 that correspond with the at least two ridges 50*a*, 50*b*. The alignment tabs 301*a*, 301*b* may also be referred to as fiducials. The divots D1, D2 formed in the exterior sidewall of the glass tube body 100 extend the entire length L1 of the glass tube body 100 to each end E1, E2 of the glass tube body 100. The divots D1, D2 at each end E1, E2 of the glass tube body 100 may be engaged by alignment tabs 301*a*, 301*b* in the sidewalls of end caps 300*a* having contacts providing electrical communication between a lamp fixture and an LED driver 202 of the lamp 500 including the glass tube body 100 and the light source 200. The alignment tabs 301*a*, 301*b* in the end caps 300*a* can provide for alignment between the end cap contacts 300*a* and the light tube body 100, as well as alignment to the light source 200 positioned by the retaining ridges 50*a*, 50*b* within the hollow interior of the glass tube body 100.

Figure 8A:
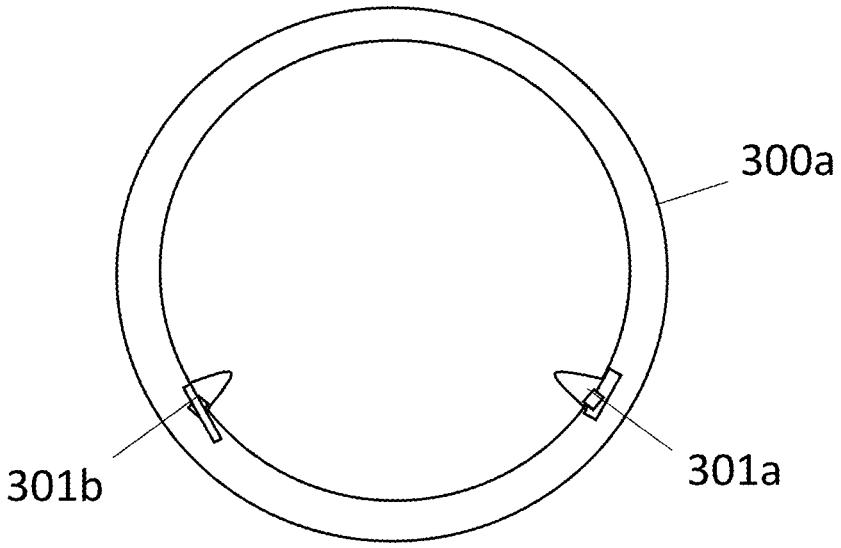
FIG. 8A is a side cross-sectional view along section line C-C of the assembly depicted in FIG. 7, in which a single set of alignment tabs that are present in the sidewall of each end cap engage a single pair of ridges in the sidewall of the glass tube body.
Figure 9:
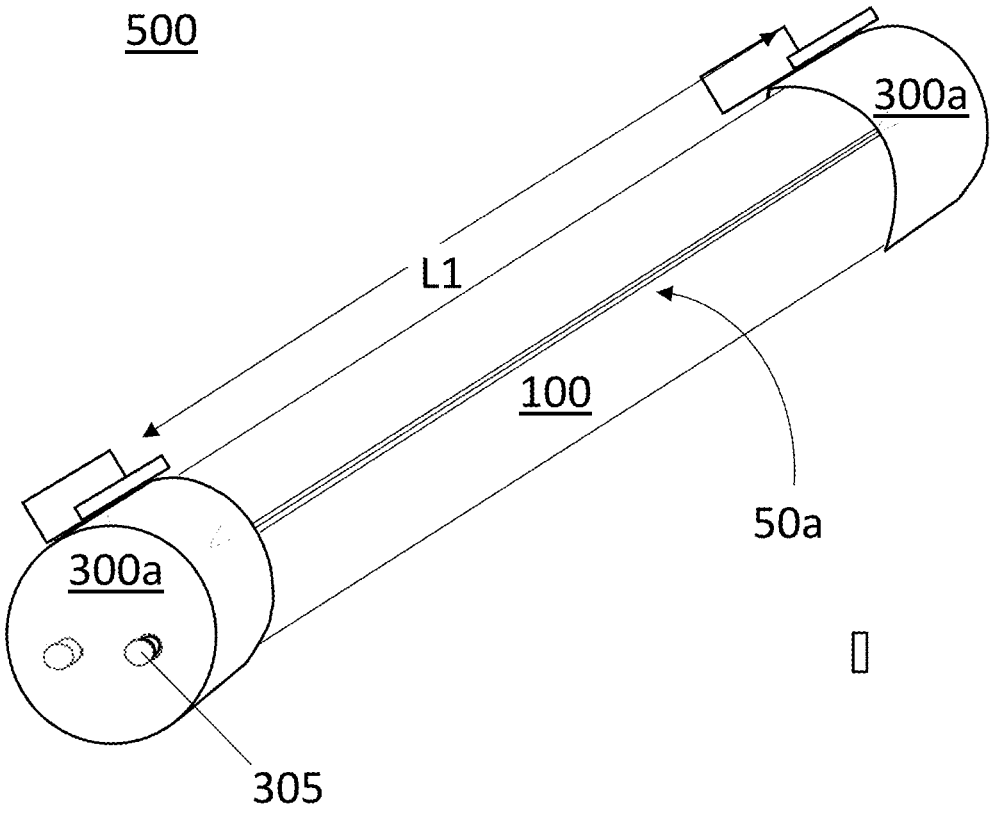
FIG. 9 is a perspective view of an assembled lamp including a glass tube body including at least one pair of retaining ridges, i.e., at least two retaining ridges, a light source housed on a circuit board engaged to the glass tube body within its hollow interior, and end caps including at least one set of alignment tabs engaged to the at least one pair of retaining ridges, in accordance with one embodiment of the present disclosure.

FIG. 8A is a side cross-sectional view along section line C-C of the assembly depicted in FIG. 7, in which a single set of alignment tabs 301*a*, 301*b* that are present in the sidewall of each end cap 300*a* engages a single pair of ridges 50*a*, 50*b* in the sidewall of the glass lamp tube 100 along their divot faces D1, D2. It is noted that the alignment tabs 301*a*, 301*b* have a dimension and geometry for engaging the divot faces D1, D2 of the ends E1, E2 of the glass tube body 100, in which the alignment tabs 301*a*, 301*b* aid in the self-alignment of the contacts 305 to the glass tube body 100, in which the contacts 305 are therefore self-aligned to the circuit board 203 of the light source 200 that is retained by the retaining ridges 50*a*, 50*b*, i.e., at least two ridges 50*a*, 50*b*. The retaining ridges 50*a*, 50*b* are on the interior sidewall of the glass tube body 100, and provide the divot faces D1, D2 of the glass tube body 100 that are present on the exterior sidewall of the glass tube body 100. Therefore, by engaging the divot faces D1, D2 of the glass tube body 100, the alignment tabs 301*a*, 301*b* align the contacts 305 of the end caps 300*a* to the elements of the light source 200 that are retained by the retaining ridges 50*a*, 50*b* on the interior sidewalls of the glass tube body 100, which correspond to the divot faces on the exterior sidewalls of the glass tube body 100. The end caps 300*a* that are depicted in FIGS. 7, 8A, and 9 engage the ends E1, E2 of the glass tube body 100, in which the glass tube body 100 includes a single pair of retaining ridges 50*a*, 50*b*.

Figure 8B:
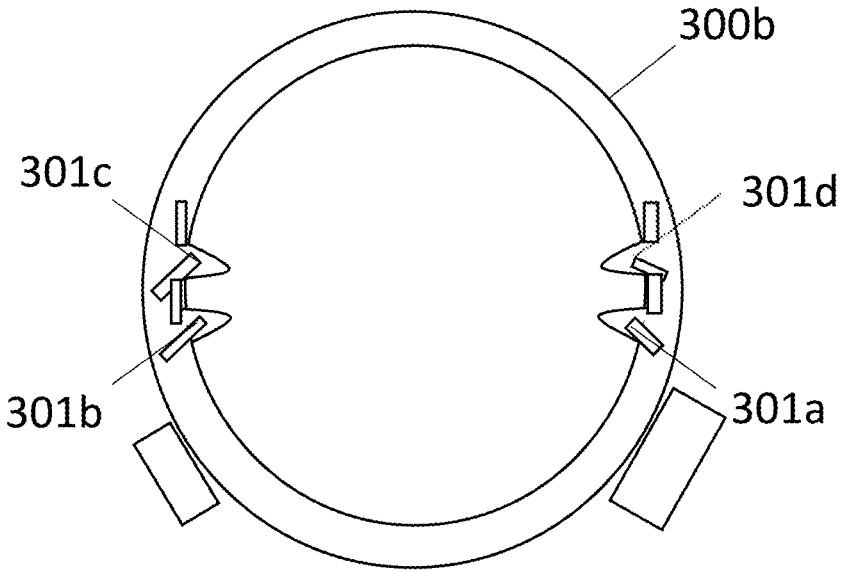
FIG. 8B is a side cross-sectional view of another embodiment of end cap for engagement to an assembly including a glass tube body and a light source housed on a circuit board, in which the end cap includes two sets of alignment tabs that are present in the sidewall of the end cap to engage two pairs of ridges in the sidewall of the glass tube body.

FIG. 8B is a side cross-sectional view of another embodiment of an end cap 300*b* for engagement to an assembly including a glass tube body 100' (as depicted in FIG. 2) and light source 200 housed on a circuit board 203 (as depicted in FIG. 4). In some embodiments, the end cap 300*b* includes two sets of alignment tabs 301*a*, 301*b*, 301*c*, 301*d* that are present in the sidewall of the end cap 300*b* to engage two pairs of ridges 50*a*, 50*b*, 50*c*, 50*d* in the sidewall of the glass lamp body 100'.

Referring to FIGS. 7-8B, the end faces of each end cap 300*a*, 300*b* include a pair of contacts 305 for engagement with a lamp fixture. The contacts 305 are typically composed of a metal, such as aluminum, steel or copper. In some embodiments, the contacts 305 may have a pin type geometry. For example, when the lamp 500 has a geometry for the T4 (13 mm) standard, the contacts 305 may be a pin type contact, in which the pins are separated by 5 mm. In another example, when the lamp 500 has a geometry for the T5 (16 mm) standard, the contacts 305 may be a pin type contact, in which the pins are separated by 5 mm. In yet another example, when the lamp 500 has a geometry for the T8 standard (26 mm), the pins may be separated by a distance of 13 mm. In an even further example, when the lamp 500 has a geometry for the T12 standard (38 mm), the pins may be separated by a distance of 13 mm. The geometry of the contacts 305 is not limited to only pin type geometries. For example, the geometry of the contacts 305 may be provided by peg fittings, single oval fittings, double oval fittings, as well as other contact geometries typically employed in lighting applications.

In some embodiments, wires (not shown) can provide electrical communication between the end caps 300*a*, 300*b*, i.e., the contacts 305 of the end caps 300*a*, 300, to the electrical components of the circuit board 203, such as the electronics driver 202 for the LEDs 201. In some embodiments, the wires are made of metals, and preferably made of copper or steels. Electrical junctions can be provided through mechanical fasteners, such as nut and bolt arrangements, and/or solder like connections.

FIG. 9 is a perspective view of an assembled lamp 500 including a glass tube body 100 including at least two retaining ridges 50*a*, 50*b*, a light source 200 housed on the circuit board 203 engaged to the glass tube body 100 at its hollow interior, and end caps 300*a* including at least one set of alignment tabs engaged to the at least one pair of retaining ridges 50*a*. The structure that is depicted in FIG. 9 illustrates the assembly following the step depicted in FIG. 7.

In another aspect of the present disclosure, a method is provided for forming the glass tube body 100, 100' that is depicted in FIGS. 1A-2. The ridges 50*a*, 50*b*, 50*c*, 50', 50", 50'" that are present on the interior sidewalls of the glass tube body 100, 100', as well as the divot faces D1, D2 on the exterior sidewalls of the glass tube body 100, 100', may be formed during the formation of the glass tube body 100 from a glass melt, and/or the ridges/divots 50*a*, 50*b*, 50*c*, 50*d*, 50', 50", 50'", D1, D2 can be formed after the initial geometry is formed from the glass melt during a reforming process, i.e., impressions applied into a semi-solidified/semi-viscous glass tube In some embodiments, the forming process may be a glass drawing used for forming glass tubing, such as the Danner process, updraw, downdraw, Vello process or a combination thereof. In each of these process, raw materials, such as glass composition, e.g., silica containing composition, such as a soda lime silicate composition, can be fed continuously into one end of a large tank furnace at a rate which balances that at which the molten glass is delivered to forming machines at the other end.

Figure 10:
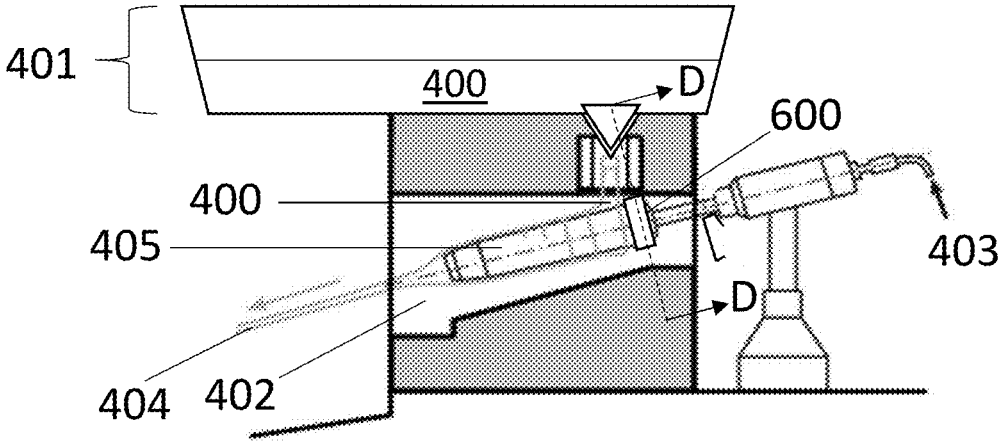
FIG. 10 is a side cross-sectional view of a mandrel for glass tube forming using a Vello type drawing process, in accordance with one embodiment of the present disclosure.
Figure 11:
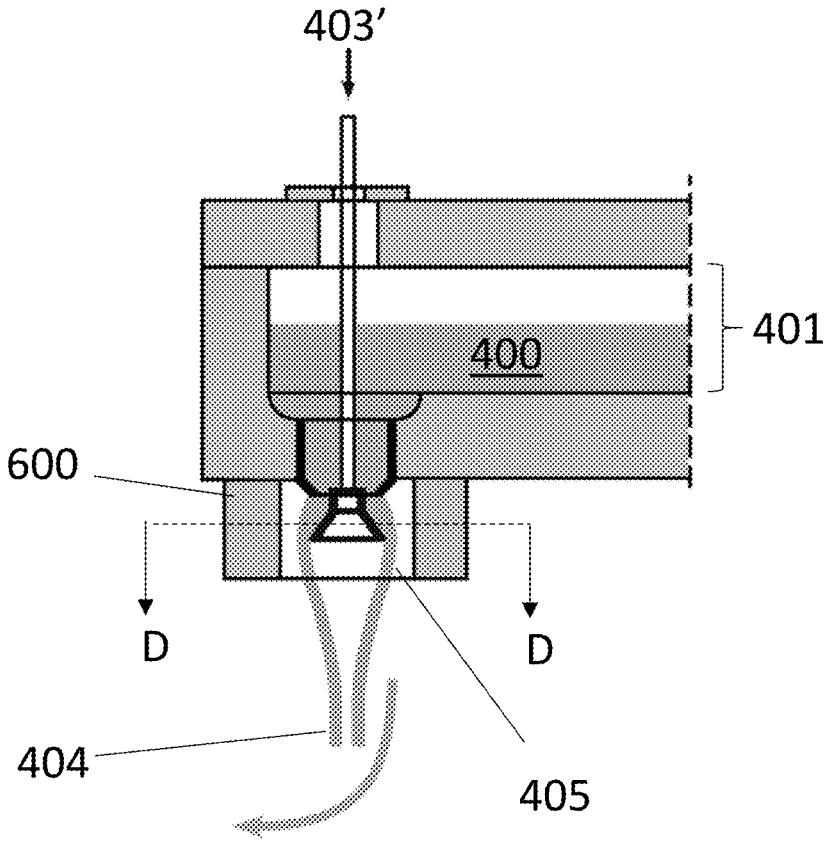
FIG. 11 is a side cross-sectional view of a mandrel for glass tube forming using a Danner type drawing process, in accordance with one embodiment of the present disclosure.

Tubing for tube lamp envelopes is continuously drawn from the same type of furnace using either the Danner or the Vello process, which are down draw forming process for forming glass tubing. FIG. 10 depicts one embodiment of a mandrel for glass tube forming using a Danner type drawing process. FIG. 11 depicts one embodiment of a mandrel for glass tube forming using a Vello type drawing process.

In the Danner process, glass 400 flows from the furnace 401 at a controlled rate onto the top of an inclined, hollow refractory mandrel 405, 405'. The glass is in a molten state in the furnace 401 and is received by the mandrel 405, 405' in a molten state. The glass from the forehearth of the furnace is allowed to flow in a ribbon from over a downward-inclined (about 20° from the horizontal), as depicted in FIG. 11. In a downdraw process, the glass flows through a centrally controlled orifice ring and is pulled vertically downwards by a tractor mechanism. In the Vello process, the glass tube is originally drawn vertically, and is then turned horizontally along support rollers.

The geometry of the glass tube 404 being formed by the Danner process and the Vello process for forming tube in accordance with the structures and methods described herein can result from a combination of a mandrel 405, 405' having a geometry that dictates at least a portion of the glass tube exterior, and a blow pipe 403, 403' that introduces air to provide a hollow interior for the glass tube 404.

In the Vello process, the glass 404 in the furnace 401 flows in to a refractory bowl which has an orifice plate in its base (the "ring"). A vertical mandrel 405, 405' is suspended through the ring. Glass is drawn between ring and the mandrel, initially vertically downwards, but then, as it cools, it is pulled through almost 90 degrees by the drawing machine on to the carbon support rollers.

Figure 12:
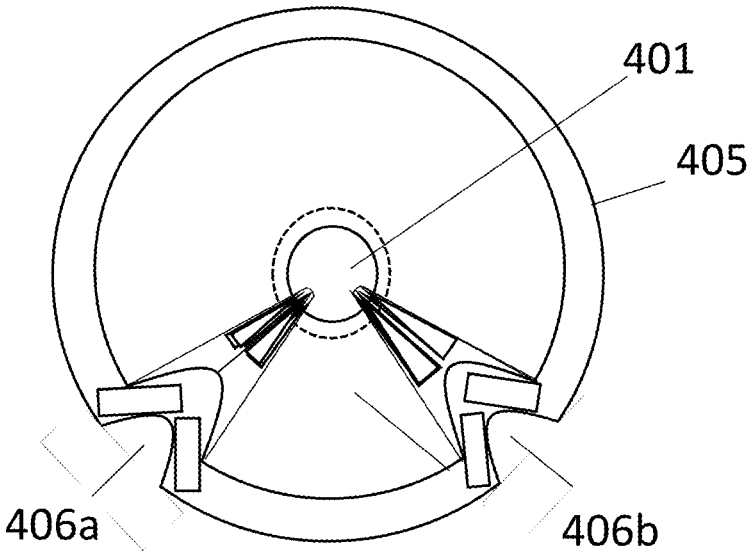
FIG. 12 is a top down view of a mandrel in which the forming surfaces of the mandrel have a cross-section that produces a glass tube having retaining ridges as depicted in FIGS. 1A-1B, in accordance with one embodiment of the present disclosure.

The mandrel 405, 405' of the Danner and/or Vello process may be composed of a metal, such as molybdenum and/or tungsten. The mandrel 405, 405' includes a hollow interior for housing the glass entering the mandrel 405, 405' from the forehearth of the furnace. The mandrel 405, 405' may include a first opening for receiving the glass 404 from the forehearth of the furnace that has a larger diameter than the orifice 401 through which the glass 404 exits the mandrel 405, 405' in a tube form 404. In some embodiments, the mandrel 405 has molding surfaces 406*a*, 406*b* that form the retaining ridges 50*a*, 50*b*, 50*c*, 50*d*, 50', 50", 50'" on the interior sidewall surface of the glass tube body 100, 100' and divot faces D1, D2 of the exterior sidewall surface of the glass tube body 100, 100', as depicted in FIG. 12. The molding surfaces 406*a*, 406*b* have a size and geometry that can create the ridges 50*a*, 50*b* of the glass tube body 100 that is depicted in FIGS. 1A and 1B. The geometry of the molding surfaces 406*a*, 406*b* can be selected to provide any retaining ridge geometry, such as the ridges 50', 50", 50'" that are depicted in FIGS. 3A-3C. FIG. 12 includes a single pair of molding surfaces 406*a*, 406*b*, which forms a single pair of retaining ridges 50*a*, 50*b* in a glass tube body 100, as depicted in FIGS. 1A-1B. In other embodiments, the mandrel 405 may include two pairs of molding surfaces to provide two pairs of retaining ridges 50*a*, 50*b*, 50*c*, 50*d*, as depicted in FIG. 2.

Figure 13:
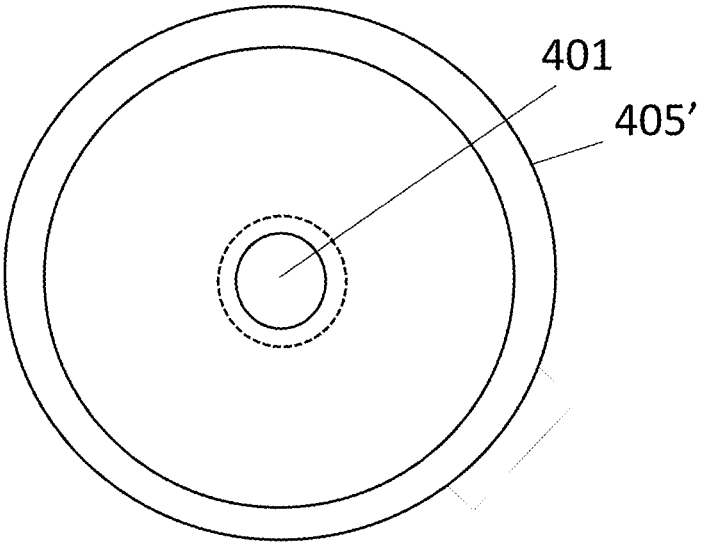
FIG. 13 is a top down view of another embodiment of a mandrel for forming the glass tube bodies described in FIGS. 1A-2, in which the mandrel does not include the molding surfaces for forming the retaining ridges of the embodiment that is depicted in FIG. 12.
Figure 16:
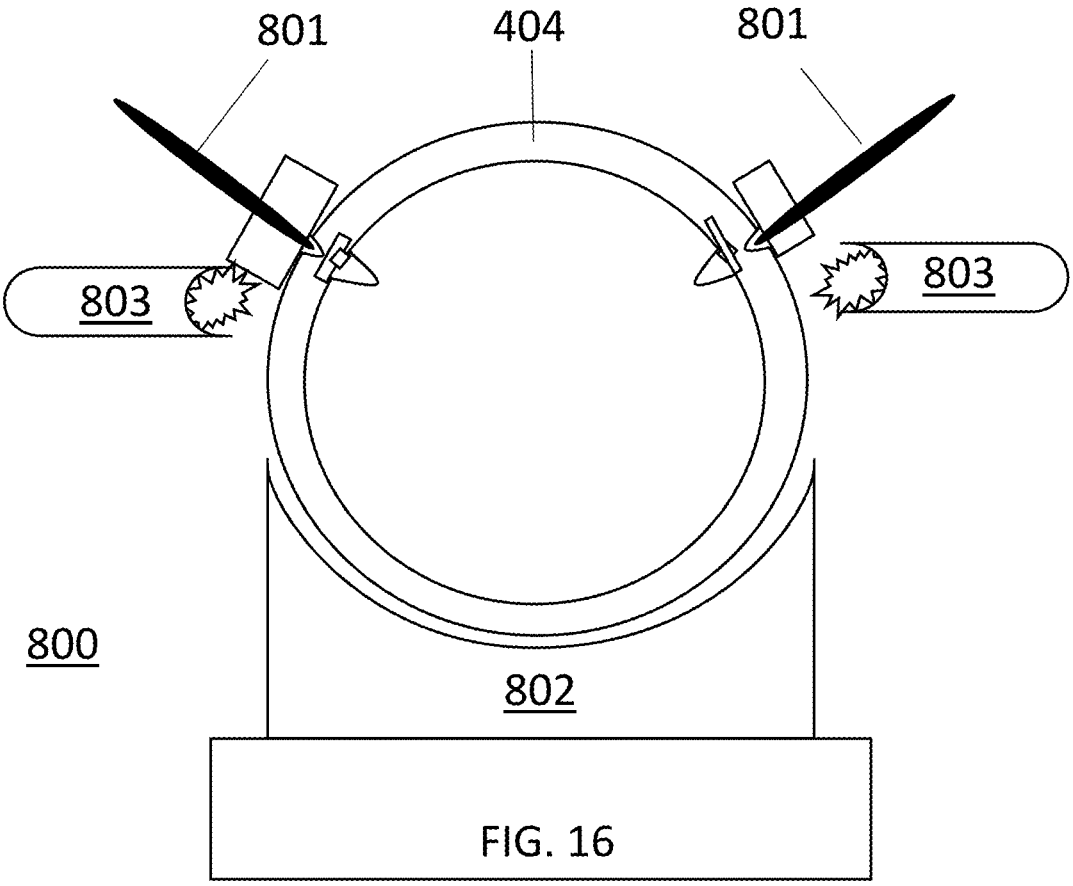
FIG. 16 is a cross-section view of a push roller apparatus for forming retaining ridges in a glass tube body following the formation of the glass tube through the mandrel, in accordance with the present disclosure.

It is not necessary that the mandrel 405 include the molding surfaces 406*a*, 406*b*. In some embodiments, a mandrel 405' may be employed to form the glass tube body 100, 100' that has a substantially circular sidewall, as depicted in FIG. 13. To provide the retaining ridges 50*a*, 50*b*, 50*c*, 50*d*, 50', 50", 50'" on the interior sidewall surface of the glass tube body 100, 100' and divot faces D1, D2 of the exterior sidewall surface of the glass tube body 100, 100', while employing the mandrel 405' that is depicted in FIG. 13, a push roller apparatus 800, as depicted in FIG. 16, for forming retaining ridges in the glass tube body 100, 100' is positioned following the formation of the glass tube 404 for the glass tube body 100, 100' through the mandrel 405'.

Referring to FIG. 10, in the Danner process, the mandrel 405, 405' can be present in a muffle 402 that can control the temperature of the mandrel 405, 405' as the glass flows within the hollow mandrel 405, 405'. The temperature of the glass can range from 600° C. to 1200° C. during the tube forming process. The glass forming temperatures may be similar to both the Danner process and Vello process, as depicted in FIGS. 10 and 11.

Figure 15:
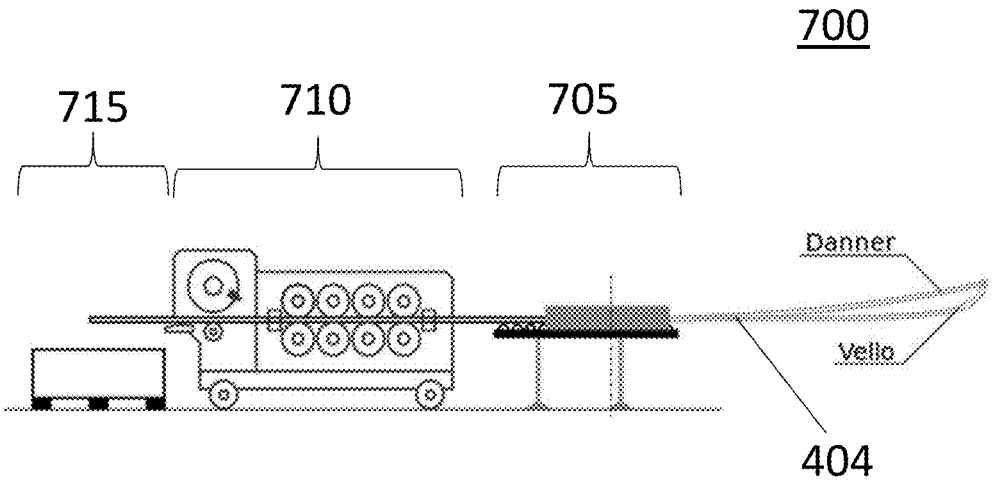
FIG. 15 is a schematic illustrating a production line for vertical tube drawing that can be used with the Vello and Danner type tube drawing methods, in accordance with one embodiment of the present disclosure.

In prior glass tube forming methods, such as a typical Danner process, the mandrel 405, 405' is rotated to manipulate the glass 400 within the mandrel 405, 405', and to traverse the glass 400 along the length of the mandrel 405, 405' from the glass receiving end of the mandrel 405, 405' to the orifice of the mandrel 405, 405' through which the glass passes in tube 404 form. In the present methods, the mandrel 405, 405' is not rotated. In the present glass tube forming methods, the mandrel 405, 405' is not rotated but a vibration is applied to the mandrel 405, 405'. The vibration that is applied to the mandrel 405, 405', in which the continuous vibration of the mandrel 405, 405' causes the glass to wrap around the mandrel 405, 405' upon the entry of the glass 400 from the furnace forehearth to the orifice of the mandrel 405, 405'. The continuous vibration of the mandrel 405, 405' also causes the glass to flow downstream of the mandrel 405, 405'. As will be described further, the glass ultimately flows off the mandrel 405, 405', where it is picked up, gradually cooled by a cooling station 705 and placed between horizontal tractors 710, as depicted in FIG. 15.

Figure 14A:
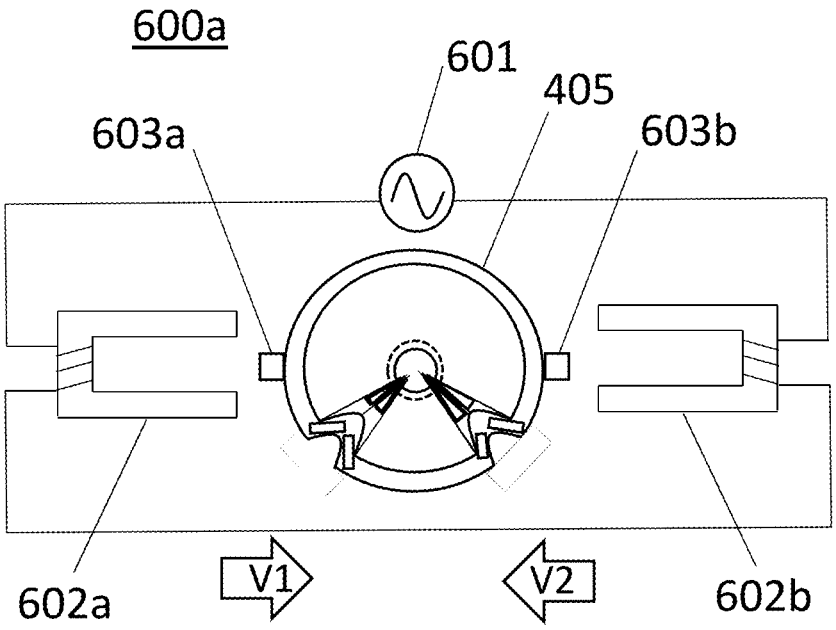
FIG. 14A is a cross-sectional view along section line D-D of FIGS. 10 and 11 depicting a magnetic system for providing a quasi-static mandrel in which the glass tube movement during formation is by jigging motion applied to the mandrel via the magnetic system without rotation, wherein the mandrel includes forming surfaces for producing at least two retaining ridges in the sidewall of the glass tube, in accordance with one embodiment of the present disclosure.
Figure 14B:
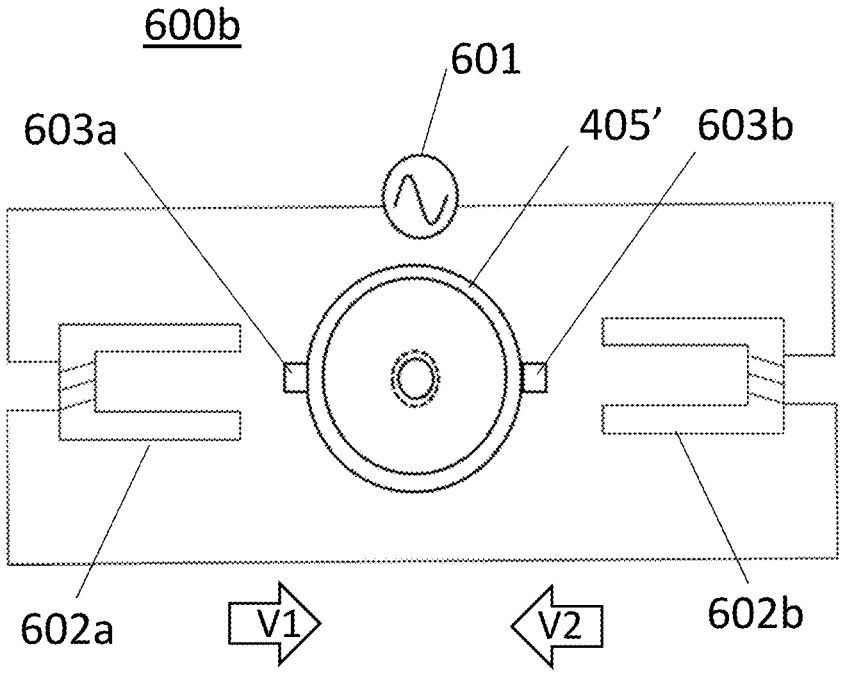
FIG. 14B is a cross-sectional view along section line D-D of FIGS. 10 and 11 depicting a magnetic system for providing a quasi-static mandrel in which the tube movement during formation is by jigging motion applied to the mandrel via the magnetic system without rotation, wherein the mandrel includes forming surfaces having a substantially circular cross-sectional shape, in accordance with one embodiment of the present disclosure.

The vibration of the mandrel 405, 405' with no rotational motion is referred to as "Qausi-static" motion. In some embodiments, the vibrational motion to cause the jiggering of the mandrel 405, 405' is applied by a magnetic jiggering system that is identified by reference number 600 in FIGS. 10 and 11. FIGS. 14A and 14B depict a magnetic system 600*a*, 600*b* for providing a quasi-static mandrel in which the tube movement during formation is by jigging motion applied to the mandrel 405, 405' via the magnetic system without rotation. In the embodiment depicted in FIG. 14A, the magnetic system 600*a* includes the mandrel 405 having forming surfaces 406*a*, 406*b* for producing at least one set of retaining ridges 50*a*, 50*b* in the sidewall of the glass tube 100. A similar device may be used to provide a glass tube body 100' including two pair of molding surfaces for forming two pairs of ridges 50*a*, 50*b*, 50*c*, 50*d*, as depicted in FIG. 2. FIG. 14B depicts another embodiment of a magnetic system 600*b* for providing a quasi-static mandrel 405' in which the tube movement during formation is by jigging motion applied to the mandrel via the magnetic system without rotation, wherein the mandrel 405' includes forming surfaces having a substantially circular cross-sectional shape. The mandrel 405' depicted in FIG. 15B does not include the molding surfaces 406*a*, 406 of the mandrel that is depicted in FIG. 14A. Either the magnetic system 600*a* that is depicted in FIG. 14A, and the magnetic system 600*b* that is depicted in FIG. 14B can be employed for the magnetic system that is identified by reference number 600 in FIGS. 10 and 11.

Referring to FIGS. 14A and 14B, the magnetic systems 600*a*, 600*b* that provides the quasi-static driving may include an AC power source 601, at least one pair of electro-magnets 602, and at least one pair of permanent magnets 603. The "AC" in the term AC power source stands for alternating current, which means the electrical current frequently reverses direction. AC electricity is measured according to its cycles, with one complete cycle being counted each time a given current travels in one direction and then doubles back on itself. The unit of measurement for an electric cycle is "Hertz" (Hz). To provide for the jiggering motion of the mandrel 405, 405', the AC power may range from 5 W to 120 W.

A magnet is a material or object that produces a magnetic field. This magnetic field is responsible for a force that pulls on other ferromagnetic materials, such as iron, and attracts or repels other magnets. In some embodiments, permanent magnets 603 is attached to opposing sides of the mandrel 405, 405'. A permanent magnet is an object made from a material that is magnetized and creates its own persistent magnetic field. Materials that can be magnetized are called ferromagnetic, and include iron, nickel, cobalt, some alloys of rare-earth metals.

Permanent magnets are made from "hard" ferromagnetic materials, such as alnico and ferrite, which are subjected to processing in a strong magnetic field during manufacture to align their internal microcrystalline structure, making them very hard to demagnetize. In the embodiments that are depicted in FIGS. 14A and 14B, a first permanent magnet 603*a* is present on a first side of the mandrel 405, 405', and a second permanent magnet 603*b* is present on a second opposing side of the mandrel 405, 405'. In some embodiments, the first permanent magnet 603*a* is positioned on a first side of the mandrel 405, 405' having a first end extending in a direction away from the center of the mandrel 405, 405' that is magnetized to a first pole, and the second permanent magnet 603*b* is positioned on a second side of the mandrel 405, 405' having a second extend extending in a direction away from the center of the mandrel 405, 405' that is magnetized to a second pole that opposed to the first pole. For example, the end of the first permanent magnet 603*a* engaged to the first side of the mandrel 405, 405' that extends from the mandrel 405, 405' is magnetized to a south pole; and the end of the second permanent magnet 603*b* engaged to the second side of the mandrel 405, 405' that extends from the mandrel 405, 405' is magnetized to a north pole.

An electromagnet is made from a coil of wire that acts as a magnet when an electric current passes through it, but stops being a magnet when the current stops. In some embodiments, the coil is wrapped around a core of ferromagnetic material, such as steel, which enhances the magnetic field produced by the coil. In some embodiments, a first electromagnet 602*a* is positioned adjacent to the first permanent magnet 603*a* that is present on a first side of the mandrel 405, 405'; and a second electromagnet 602*b* is positioned adjacent to the second permanent magnet 603*b* that is positioned on a second opposing side of the mandrel 405, 405'. The first and second electromagnets 602*a*, 602*b* are connected to the AC power source 601. For example, the wire of the electromagnetics 602*a*, 602*b* may be connected to the AC power source 601. Modulation of the AC power source 601 causes the electromagnets 602*a*, 602*b* to turn ON and to turn OFF.

In some embodiments, when the first permanent magnet 603*a* and the first electromagnet 602*a* are magnetized to a same pole, e.g., both the first permanent magnet 603*a* and the first electromagnet 602*a* are magnetized to a north pole, a repulsive force exists between the magnets causes the mandrel 405, 405' to be traversed in a first vibrational direction V1. In some embodiments, when the first permanent magnet 603*a* and the first electromagnet 602*a* are magnetized to opposite poles, e.g., the first permanent magnet 603*a* is magnetized to a south pole and the first electromagnet 602*a* is magnetized to a north pole, an attractive force exists between the magnets that causes the mandrel 405, 405' to be traversed in a second vibrational direction V2. In some embodiments, when the second permanent magnet 603*b* and the second electromagnet 602*b* are magnetized to a same pole, e.g., both the second permanent magnet 603*b* and the second electromagnet 602*b* are magnetized to a north pole, a repulsive force exists between the magnets causes the mandrel 405, 405' to be traversed in a second vibrational direction V2. In some embodiments, when the second permanent magnet 603*b* and the second electromagnet 602*b* are magnetized to opposite poles, e.g., the second permanent magnet 603*b* is magnetized to a south pole and the second electromagnet 602*b* is magnetized to a north pole, an attractive force exists between the magnets that causes the mandrel 405, 405' to be traversed in a first vibrational direction V1.

The movement of the mandrels 405, 405' back and forth in the first vibrational direction V1 and the second vibrational direction V2 may be referred to as a jigger motion. This is a linear motion, and not a rotational motion. Modulation of the AC power 601 can turn the electromagnets 602*a*, 602*b* ON, and can turn the electromagnets 602*a*, 602*b* OFF.

In some embodiments, the viscous nature of the molten glass 400, and the jigger motion/vibrational motion of the mandrels 405, 405' causes the molten glass to pass through the mandrel 405, 405'. The molten glass 400 is traversed over the molding surfaces 406*a*, 406*b* of the mandrel 405, which form impressions on the exterior sidewall of the glass tube 404. The impressions provide the divot faces D1, D2 and the ridges 50*a*, 50*b*, 50*c*, 50*d*, 50', 50", 50'" of the interior sidewall of the glass tube 404.

In some embodiments, while the glass 400 is being traversed through the mandrel 405, 405', air is blown down the center of the mandrel 405, 405'. The air can be introduced to the mandrel 405, 405' through an air tube 403. The introduction of the air creates the hollow interior of the glass tube 404 for the glass tube body 100, 100'. In the embodiment, in which the mandrel 405 includes molding surfaces 406*a*, 406*b*, as depicted in FIG. 12, the air that forms the hollow interior also applies a force to the interior sidewalls of the glass tube body 100, 100' that forces the glass material over the molding surfaces 406*a*, 406*b*, which can aid in the conformal sidewall thickness at the ridges 50*a*, 50*b*, 50*c*, 50', 50", 50'".

Referring to FIG. 15, the glass tube 404, as it solidifies, is supported between the mandrel 405, 405' and the drawing machine 710 by a series of shaped carbon rollers placed at regular intervals. The size of the tubing drawn depends on the diameter of the mandrel, the draw speed, and the amount of blowing air, the glass temperature and the cooling rate. The cooling rate can be adjusted through a furnace/cooling apparatus 705.

In some embodiments, the mandrel 405 including the molding surfaces 406*a*, 406*b* in combination with the magnetic system 600*a* that provides the quasi-static driving can produce the glass tube body 100 having the ridges 50*a*, 50*b*, 50', 50", 50''' and divot faces D1, D2 that are depicted in FIGS. 1A-1B and FIG. 3. The mandrel 405 may be modified with two additional molding surfaces to provide the glass tube body 100' that is depicted in FIG. 2. In some embodiments, such as when the glass tube 404 is being formed using the Vello process, which does not include rotational motion of the mandrel, the magnetic system 600*a* may be omitted.

In some embodiments, the retaining ridges 50*a*, 50*b*, 50*c*, 50*d*, 50', 50", 50''' may be formed using a mandrel 405', as depicted in FIG. 13, which does not include molding surfaces, such as the molding surfaces 406*a*, 406*b* of the mandrel 405 depicted in FIG. 12. In some embodiments, to provide the ridges 50*a*, 50*b*, 50*c*, 50*d*, 50', 50", 50''' using the mandrel 405' depicted in FIG. 13, a push roller apparatus 800, as depicted in FIG. 16, for forming ridges in a glass tube body 100 is positioned following the formation of the glass tube body 100 through the mandrel 405'.

Referring to FIG. 16, the push roller apparatus 800 is positioned after the mandrel 405, 405' at a point at which the glass 400 of the glass tube 404 has cooled from a viscous state to a semi-solid state or solid state. The rollers 801 have an impression forming geometry having a shape and dimension to form the divot faces D1, D2 on an exterior surface of the glass tube 404, and to form the ridges 50*a*, 50*b*, 50*c*, 50*d*, 50', 50", 50''' on the interior surface of the glass tube 404. The rollers 801 may be composed of a metal and/or refractory material, e.g., ceramic. For example, the rollers 801 may be composed of steel, tungsten, molybdenum and combinations thereof. The rollers 801 can also be composed of refractory material, such as alumina ($Al_2O_3$). The rollers 801 typically rotate about a central axis. The diameter face of the rollers 801 provide the impression forming surface of the push roller apparatus 800. In some embodiments, a backing substrate 802 can support the glass tube 404 while the rollers 801 of the push roller apparatus 800 apply the impression force through the rollers 801 to form the divot faces D1, D2 on an exterior surface of the glass tube 404, and to form the ridges 50*a*, 50*b*, 50*c*, 50*d*, 50', 50", 50''' on the interior surface of the glass tube 404.

Referring to FIG. 16, the push roller apparatus 800 forms the ridges 50*a*, 50*b*, 50*c*, 50*e*, 50', 50", 50''' and divot faces D1, D2 while the glass tube 404 is at a temperature that provides that the sidewall of the glass tube 404 is soft enough, i.e., viscous enough, for impression. In some embodiments, extra flame heat 803 may be applied to the portions of the glass tube 404 at which the rollers 801 apply force to form the divots D1, D2 on the exterior sidewall, and the ridges 50*a*, 50*b*, 50*c*, 50*e*, 50', 50", 50''' on the interior sidewall, of the glass tube 404.

In some embodiments, the push roller apparatus 800 may be used in combination with the mandrel 405 depicted in FIG. 12, in which the mandrel 405 includes molding surfaces 406*a*, 406*b* for forming the ridges in the glass tube 404. In some embodiments, such as in Vello processing tube drawings that do not apply a rotational motion to the mandrel 405, 405', the push roller apparatus 800 may be used without the magnetic systems 600*a*, 600*b* that are depicted in FIGS. 14A and 14B.

Following the formation of the glass tube 404 including the divots D1, D2 on the exterior sidewall, and the ridges 50*a*, 50*b*, 50*c*, 50*e*, 50', 50", 50''' on the interior sidewall of the glass tube 404, the glass tube 404 may be sectioned at the sectioning stage 715 of the glass tube production line 700, in which each sectioned portion of the glass tube 404 can provide a glass tube body 100, 100', as described with reference to FIGS. 1A-2.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Spatially relative terms, such as "forward", "back", "left", "right", "clockwise", "counter clockwise", "beneath," "below," "lower," "above," "upper," and the like, can be used herein for ease of description to describe one element's or feature's relationship to another element(s) or feature(s) as illustrated in the FIGS. It will be understood that the spatially relative terms are intended to encompass different orientations of the device in use or operation in addition to the orientation depicted in the FIGS.

Having described preferred embodiments of methods and structures relating to glass tubes for light emitting diodes (LEDs) light source lamps, it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A lamp tube comprising:

a glass tube body having a cross-sectional geometry that is perpendicular to a length of the glass tube body with a substantially cylindrical perimeter defined by a sidewall of the glass tube body enclosing a hollow interior for housing a light source, the sidewall of the glass tube body that defines the substantially cylindrical perimeter including at least two ridges on an interior surface of the sidewall that provides the substantially cylindrical perimeter, each ridge of said at least two ridges comprises an apex extending towards the hollow interior for the glass tube body, and said each ridge extends continuously with uniform dimensions along a majority of the length of the glass tube body, wherein from a perspective of an exterior surface of the sidewall of the glass tube body a divot is present corresponding to said each ridge.

2. The lamp tube of claim 1, wherein the pair of ridges retain edges of a circuit board including the light source between each of the pair of ridges and a portion of the sidewall of the glass tube body.

3. The lamp tube of claim 1, wherein the glass tube body is comprised of a soda lime silicate glass.

4. The lamp tube of claim 1, wherein said each ridge of the pair of ridges has a protruding width towards the hollow body of the glass tube body that ranges from 1/10 a width of the glass tube body to 1/5 the width of the glass tube body.

5. The lamp tube of claim 1, wherein the apex of said each ridge of the at least two ridges is present at a peak of a convex curvature in the sidewall of the glass tube body relative to a center of the hollow interior for the glass tube body.

6. The lamp tube of claim 1, the divot having a concave curvature extending toward the hollow interior for the glass tube body.

7. The lamp tube of claim 6, wherein a sidewall thickness of the glass tube body at portions including said each ridge and said each divot corresponding to said each ridge is substantially equal to a sidewall thickness of the glass tube body at remaining portions that do not include said each ridge and said each divot corresponding to said each ridge.

8. The lamp tube of claim 1, wherein the at least two ridges comprises two pairs of ridges, wherein a first of said at least two pairs of ridges contacts an upper surface of a circuit board including the light source and a second of said at least two pairs of ridges contacts a lower surface of the circuit board including the light source to retain the circuit board between the two pairs of ridges.

9. A lamp comprising:

a glass tube body having a cross-sectional geometry that is perpendicular to a length of the glass tube body with a substantially cylindrical perimeter defined by a sidewall of the glass tube body enclosing a hollow interior, the sidewall of the glass tube body that defines the substantially cylindrical perimeter including at least two ridges on opposing interior sidewall surfaces of the substantially cylindrical perimeter, wherein said each ridge of said at least two ridges extends continuously with uniform dimensions along a majority of the length of the glass tube body, wherein from a perspective of an exterior surface of the sidewall of the glass tube body a divot is present corresponding to said each ridge; and a light source present within the hollow interior of the glass tube body, the light source present on a circuit board having edges in between the at least two ridges and a portion of the sidewall of the glass tube.

10. The lamp of claim 9, wherein the circuit board includes light emitting diodes (LED), and the circuit board is engaged to the glass tube body by a first fitment contact between a first edge of a light emission face of the circuit board that the light emitting diodes (LED) are present on to the at least two ridges, and a second fitment contact of a second edge of a back face of the circuit board to portions of the sidewall of the glass tube body that extends from a first ridge of the at least two ridges on one side of the glass tube body to a second ridge of the at least two ridges on an opposing second side of the glass tube body.

11. The lamp of claim 10, wherein the circuit board further comprises an internal built in ballast and printed circuitry providing electrical communication between the ballast and the light emitting diodes (LED).

12. The lamp of claim 9, wherein an apex for each ridge of the at least two ridges is present at a peak of a convex curvature in the sidewall of the glass tube body relative to a center of the hollow interior for the glass tube body.

13. The lamp of claim 9, wherein the divot having a concave curvature extending toward the hollow interior for the glass tube body.

14. The lamp of claim 13, wherein a sidewall thickness of the glass tube body at portions including said each ridge and said each divot corresponding to said each ridge is substantially equal to a sidewall thickness of the glass tube body at remaining portions that do not include the ridges and ridges and said each divot corresponding to said each ridge.

15. The lamp of claim 9 further comprising end caps present on opposing ends of the glass tube body, wherein the end caps have alignment tabs for engagement to the at least two ridges at the opposing first and second ends of the glass tube body, wherein the alignment tab for the end caps fits within a divot face of the at least two ridges at the first and second ends of the glass tube body present on an exterior sidewall of the glass tube body.

16. The lamp of claim 9, wherein the at least two ridges comprises two pairs of ridges, wherein a first of said at least two pairs of ridges contacts a light emission face of the circuit board including the light source and a second of said at least two pairs of ridges contacts a back face of circuit board to retain the circuit board between the two pairs of ridges.

17. A method of lamp assembly comprising:

providing a glass tube body having a cross-sectional geometry that is perpendicular to a length of the glass tube body with a substantially cylindrical perimeter defined by a sidewall of the glass tube body enclosing a hollow interior for housing a light source, the sidewall of the glass tube body that defines the substantially cylindrical perimeter including at least one pair of ridges on opposing sides of the substantially cylindrical perimeter, wherein from a perspective of an exterior surface of the sidewall of the glass tube body a divot is present corresponding to said each ridge; and sliding a circuit board including at least one light source along the at least one pair of ridges to position the circuit board including the at least one slight source into the hollow interior of the glass tube, wherein edges of the circuit board are retained between the at least one pair of ridges and a portion of the glass tube sidewall extending from a first ridge to a second ridge of the at least one pair of ridges.

18. The method of claim 17, wherein the divot having a concave curvature extending towards the hollow interior for the glass tube body.

19. The method of claim 17, wherein a sidewall thickness of the glass tube body at portions including said each ridge and said divot corresponding to said each ridge is substantially equal to a sidewall thickness of the glass tube body at remaining portions that do not include the ridges and ridges and said each divot corresponding to said each ridge.

20. The method of claim 17, further comprising installing end caps on opposing ends of the glass tube body, wherein the end caps have alignment tabs for engagement to the at least one pair of ridges at the opposing first and second ends of the glass tube body, wherein the alignment tab for the end caps fits within a divot face of the ridges at the first and second ends of the glass tube body present on an exterior sidewall of the glass tube body.

* * * * *